US006837574B2

(12) United States Patent
Yamada et al.

(10) Patent No.: US 6,837,574 B2
(45) Date of Patent: Jan. 4, 2005

(54) LINE SCAN TYPE INK JET RECORDING DEVICE

(75) Inventors: Takahiro Yamada, Hitachinaka (JP); Shinya Kobayashi, Hitachinaka (JP); Hitoshi Kida, Hitachinaka (JP); Kunio Satou, Hitachinaka (JP); Toshitaka Ogawa, Hitachinaka (JP); Yoshikane Matsumoto, Hitachinaka (JP); Katsunori Kawasumi, Hitachinaka (JP); Kazuo Shimizu, Hitachinaka (JP)

(73) Assignee: Hitachi Printing Solutions, Ltd., Kanagawa (JP)

( * ) Notice: Subject to any disclaimer, the term of this patent is extended or adjusted under 35 U.S.C. 154(b) by 175 days.

(21) Appl. No.: 10/169,162

(22) PCT Filed: Dec. 28, 2000

(86) PCT No.: PCT/JP00/09423

§ 371 (c)(1),
(2), (4) Date: Sep. 5, 2002

(87) PCT Pub. No.: WO01/47713

PCT Pub. Date: Jul. 5, 2001

(65) Prior Publication Data

US 2003/0058289 A1 Mar. 27, 2003

(30) Foreign Application Priority Data

Dec. 28, 1999 (JP) ..... 11-372265
Jan. 6, 2000 (JP) ..... 2000-000716

(51) Int. Cl.[7] ..... B41J 2/155

(52) U.S. Cl. ..... 347/77; 347/42

(58) Field of Search ..... 347/12, 13, 42, 347/77, 78, 81, 82, 14, 40, 68, 19

(56) References Cited

U.S. PATENT DOCUMENTS 4,219,822 A * 8/1980 Paranjpe ..... 347/42
4,424,518 A 1/1984 Suzuki et al.
4,533,925 A 8/1985 Tsao et al.
4,642,653 A 2/1987 Ito et al.
4,905,018 A 2/1990 Regnault
5,049,899 A 9/1991 Dunand et al.
6,183,063 B1 * 2/2001 Bolash et al. ..... 347/42

FOREIGN PATENT DOCUMENTS

EP 0 293 496 12/1988

(List continued on next page.)

OTHER PUBLICATIONS

European Search Report date Jan. 28, 2003.
European Search Report dated Apr. 14, 2003.
Patent Abstract of Japan, vol. 017, No. 679 05229129 " Citizen Watch Co. Ltd.".
3. Patent Abstract of Japan, vol. 005, No. 025 55154172 " Ricoh Co Ltd.".

*Primary Examiner*—Lamson Nguyen
(74) *Attorney, Agent, or Firm*—Whitham, Curtis & Christofferson, P.C.

(57) ABSTRACT

A recording head 200 has a plurality of nozzle orifices aligned in a row extending in a first direction. The recording head 200 is arranged with the nozzle orifices in confrontation with a recording medium P. The recording medium P is moved in a second direction B with respect to the recording head 200. Also, ink droplets ejected from the nozzle orifices are charged to a charged amount that corresponds to deflection amount of the ink droplets. The charged ink droplets are deflected in a direction perpendicular to a main scanning line. The plurality of ink droplets ejected from the plurality of nozzle orifices impinge on the same pixel position or at a nearby position so that it is possible to impinge multiple droplets at the same pixel position or a nearby position. As a result, it is possible to back up broken nozzles and to reduce recording distortion.

14 Claims, 22 Drawing Sheets

FOREIGN PATENT DOCUMENTS

| | | | |
|---|---|---|---|
| EP | 0747220 | A2 | 6/1996 |
| EP | 0 780 230 | A3 | 6/1997 |
| EP | 0 780 230 | A3 | 9/1998 |
| JP | 1-17865 | | 4/1989 |
| JP | 2-62243 | | 3/1990 |
| JP | 5-229125 | | 9/1993 |
| JP | 11-170516 | | 6/1999 |

* cited by examiner

LINE SCAN TYPE INK JET RECORDING DEVICE

TECHNICAL FIELD

The present invention relates to a line scan type ink jet recording device, and more particularly to a line scan type ink jet recording device capable of recording high-quality images with high reliability.

BACKGROUND ART

A line scan type ink jet recording device has been proposed as a high-speed ink jet recording device for printing on recording sheets at high speed. The device has an elongated ink jet recording head that extends across the entire width of the recording sheet. The recording head is formed with a row of nozzle orifices through which ink droplets are ejected. Ink droplets are ejected through the nozzle orifices of the recording head that confronts the recording sheet while performing a main scan to consecutively move the recording sheet. "Main scan" means scanning movement of the recording sheet in the movement direction. Lines extending in the main scan direction on the recording sheet that the nozzle orifices confront are referred to as "main scan lines". By this type of control, recording dots are selectively formed on the scan lines of the recording sheet.

Line scan type ink jet recording devices include those that use continuous type ink jet recording head and those that use on-demand type ink jet recording heads. Although on-demand type ink jet recording devices do not record as quickly as continuous type ink jet recording devices, they are appropriate for a popularized high-speed recording device for reasons such as the ink system is extremely simple.

Japanese Patent Application Publication No. HEI-11-78013 discloses an example of recording heads used in on-demand type ink jet recording devices. The recording head is formed with a row (line) of nozzles, wherein the nozzles are in a one-to-one correspondence with main scan lines of the recording sheet. That is, a number of the nozzles is the same as the number of the main scan lines. Each nozzle has an ink chamber opened with the nozzle orifice. Pressure is applied to the ink in the ink chambers by applying a drive voltage to thermal elements or piezoelectric elements, so that ink droplets are ejected through the nozzle orifices. With this configuration, high-speed recording devices having a simple configuration can be provided.

However, because nozzles in a number equivalent to the number of scan lines are used, in order to record an image with, for example, a dot density of 300 dpi on a 18-inch wide recording sheet, then 5,400 main scan lines are needed. Accordingly, 5,400 nozzles are required even in a monochromatic recording device, and 21,600 nozzles are required in a multicolor recording device that prints in a four colors of ink.

It is possible to realize this type of plural nozzle arrangement for producing an on-demand type ink jet recording device having a high nozzle density. However, a break down in only one of the multiplicity of nozzles causes a fatal problem for the head because a corresponding scan line will be unrecordable so that information that should be recorded will be lost.

Such a nozzle break down can be caused by a variety of reasons, such as an inability to eject ink droplets due to a clogged nozzle orifice or an air bubble in the nozzle, or a bend in the ink ejection direction associated with a half-clogged nozzle orifice or a non-uniform leak of ink to the area around the nozzle orifice. Because it is extremely difficult to regularly prevent these types of break-downs in the plural nozzles during operations, it has been difficult to insure reliability of recording.

Also, there is a problem relating to insuring quality of recorded images. That is, it is difficult to produce a plurality of nozzles with the same dimensions. The ink ejection characteristics of the nozzles can vary because of poor uniformity in production and other reasons.

For example, when ink droplets ejected from adjacent nozzles have a significant lack uniformity in shape, size, and the like, recording distortions, such as line distortions and density distortions, are generated. It is possible in serial type recording heads to make the poor uniformity of ink droplet size less striking by changing the scan region of the recording head. However, the line type recording head that is used fixed in place cannot be used if the recording head has nozzles with poor uniformity because the adjacent nozzles are fixed in place. On the other hand, production yield is extremely poor when producing recording heads with nozzles uniform to a level sufficient to not be problematic. Also, even if the nozzle characteristics are uniform at first, the ejection characteristics of adjacent nozzles can vary for some reasons during operations. This is a problem related to insuring recording quality.

U.S. Pat. No. 5,975,683, which corresponds to Japanese Patent Application Publication No. HEI-8-332724, discloses a line scan type ink jet recording device that manipulates ink droplets using an electric field. This device uses an electric field to deflect ejected ink droplets in the left or right directions to increase the number of dots in the horizontal direction within a single pixel, and to form higher-resolution images. This device will be described in detail with reference to the attached drawings.

A print head 18 shown in FIG. 1 uses an actuator 11 to eject ink droplets 10 from an opening 13 toward a print surface 15. At this time, the positive ions in the ink react to a high negative voltage (−1,000V) of an electrode 14, which is provided behind the print surface 15, and gather in ink surfaces 12. When the ink droplets 10 separate from the ink surfaces 12, the ink droplets 10 are charged to a positive charge. A pair of direction control electrodes 16, 17 are provided on either side of each opening 13. With this configuration, by developing a voltage of −100V at the direction control electrode 16 and a voltage of +100V at the direction control electrode 17, the ink 10 ejected from the openings 13 can be deflected in accordance with well-known laws of static electricity, so the ink 10 flies in directions indicated by arrows in the drawing. Also, by developing a voltage of +100V at the direction control electrode 16 and a voltage of −100V at the direction control electrode 17, then the ink 10 can be deflected to the opposite direction. By developing an electrical bias of 0V at both of the direction control electrodes 16, 17, then the ink droplets 10 fly without being deflected leftward or rightward. By controlling the direction control electrodes 16, 17 in this manner, as shown in FIG. 2, three dots including a right-side dot, a central dot, and a left-side dot can be formed within a single pixel so that an image with high resolution in the horizontal direction can be formed.

However, a deflection electric field control method that controls an electric field between the direction control electrodes 16, 17 and the print surface 15 in this way cannot control deflection of each ink droplet independently. This is because if any ink droplets which has been previously ejected and deflected exist within a presently generated deflection field, the presently generated deflection filed operates on such previously ejected and deflected ink droplets also. For this reason, the device has poor independent deflection operation, which is inconvenient for high-speed recording and for recording efficiency.

This type of recording device does not differ from the above-described device with regards to generating unrecordable scan lines and losing information that should be recorded when even a single nozzle breaks down.

DISCLOSURE OF THE INVENTION

It is an object of the present invention to overcome the above problems, and the present invention provides a line scan type ink jet recording device that uses a charging control type deflection means and an on-demand ink jet type recording head. According to the line scan type ink jet recording device of the present invention, recording can be continued without any loss of information, even if several of the nozzles break down. The number of nozzles can be reduced and recording reliability can be strikingly improved. Recording distortion can be reduced even if adjacent nozzles are non uniform to a certain extent.

It is another objective of the present invention to provide a high-speed ink jet recording device capable of recording high-quality images with high reliability.

To achieve the above-described objectives, the present invention provides a line scan type ink jet recording device wherein a recording head has a plurality of nozzle orifices aligned in a row in a first direction and ink chambers that are opened to the nozzle orifices, the recording head controlling to eject and not eject ink droplets from the nozzle orifices by generating pressure in ink in the ink chambers according to a recording signal, the recording head being disposed so that the nozzle orifices confront a recording medium, and the recording medium is moved relative to the recording head in a second direction to impinge the ink droplets at predetermined pixel positions on a predetermined main scan line for forming a recorded image by recording dots formed on the recording medium by the impinged ink droplets, the line scan type ink jet recording device being characterized by an ink droplet charge means for charging ink droplets ejected from the nozzle orifices in correspondence with a deflection amount of the ink droplets, a deflection means for deflecting the charged ink droplets in a direction that is perpendicular with the main scan line, and an overlap recording control means for controlling the ink droplet charge means and the ejection timing of the ink droplets so that the plurality of ink droplets ejected from a plurality of nozzle orifices impinge on or near the same pixel position. In the above line scan type ink jet recording device, the second direction is tilted at a predetermined angle with respect to the first direction.

This line scan type ink jet recording device enables performing back up of broken nozzles. Loss of information that should be recorded can be avoided. Also, by impinging plural dots one on the other, recording distortion caused by variation in ink ejection characteristic, which can be caused by production variation of the nozzles, can be reduced.

According to the present invention a single pixel is formed by a plurality of ink droplets ejected from a plurality of nozzle orifices, and the overlap recording control means controls volume of each of the plurality of ink droplets ejected from the plurality of nozzle orifices. The ink droplets ejected from the plurality of nozzle orifices to form the single pixel are controlled to have a suitable volume to form the single pixel.

Also, according to the present invention, the overlap recording control means controls the ink droplets charge means and the ejection timing of the plurality of ink droplets so as to mutually shift the impingement position of the plurality of ink droplets ejected from the plurality of nozzle orifices and consecutively and partially overlap recording dots formed on the recording medium to form a single pixel.

The overlap recording control means controls the ink droplet charge means and the ejection timing of the plurality of ink droplets to form a single pixel by impinging an ink droplet ejected from one of the plurality of nozzles on or near the same pixel position and to form a pixel adjacent to the single pixel by impinging an ink droplet ejected from different one of the plurality of nozzles.

The ejection timing of the plurality of ink droplets controlled by the overlap recording control means is preferably a fixed interval.

The number of the plurality of ink droplets that the overlap recording control means controls can be switched.

The overlap recording control means controls the ink droplet charge means and ejection timing of the plurality of ink droplets so that a nozzle interval in a direction perpendicular to the second direction and an interval of recorded pixels in the direction that is perpendicular to the second direction are different. In this manner, the fineness of the recording can be changed without changing the nozzle orifice arrangement.

It is preferable to simultaneously perform a charge operation by the ink droplet charge means that applies a charge in correspondence with the deflection amount to the ink droplets ejected from nozzle orifices and a deflection operation by the deflection means that deflects the charged ink droplets in accordance with charge amount by applying a voltage is applied to the charge deflection electrode arranged in confrontation with the nozzle orifices. In this case, the charge voltage and the deflection voltage are applied to the charge deflection electrode in a superimposed condition. The charge deflection electrode is preferably provided on both sides that sandwich the row of nozzle orifices as a common electrode of the single row's worth of nozzle orifices. The charge deflection electrode is provided either between the recording medium and nozzles or at the rear surface of the recording medium.

BEST MODE FOR CARRYING OUT THE INVENTION

Figure 1:
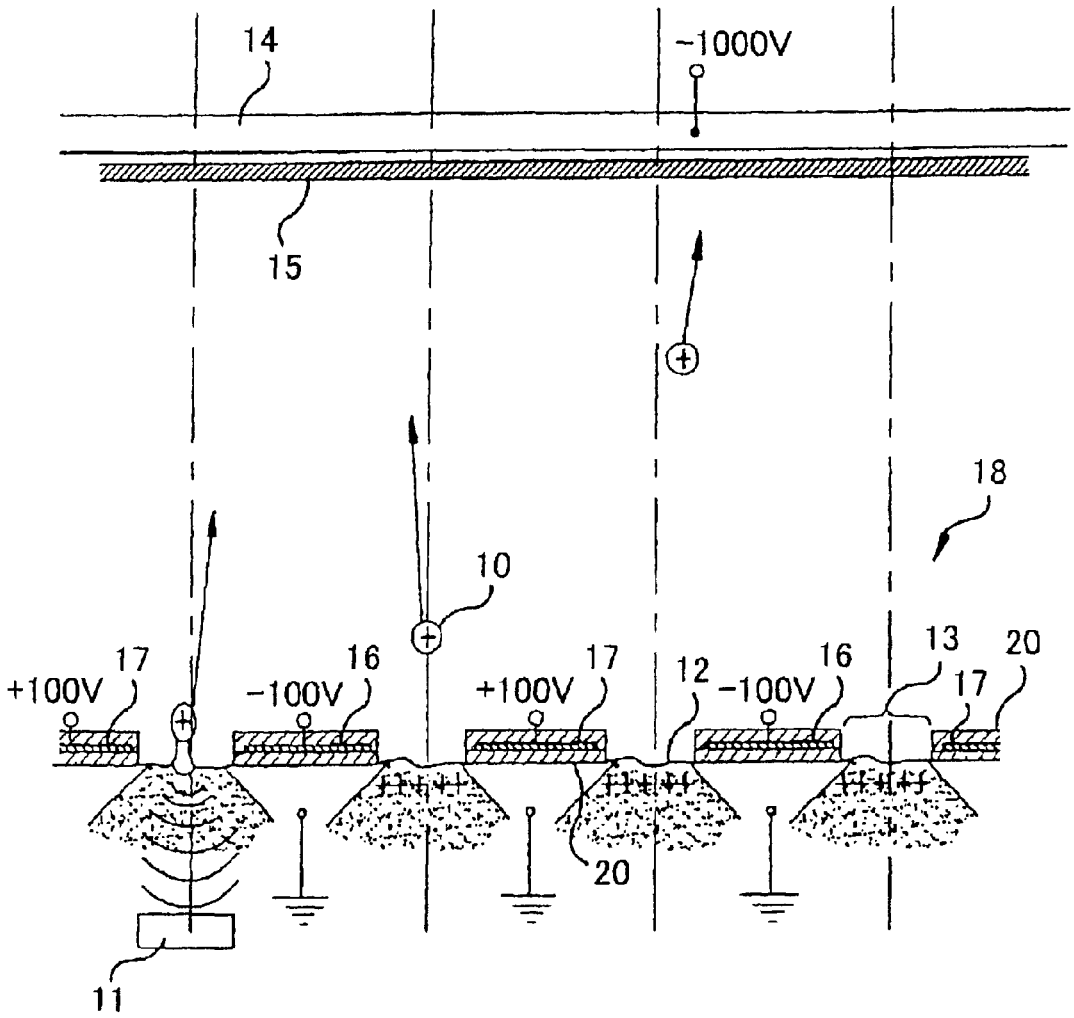
FIG. 1 is a schematic view showing configuration of a conventional ink jet head.
Figure 2:
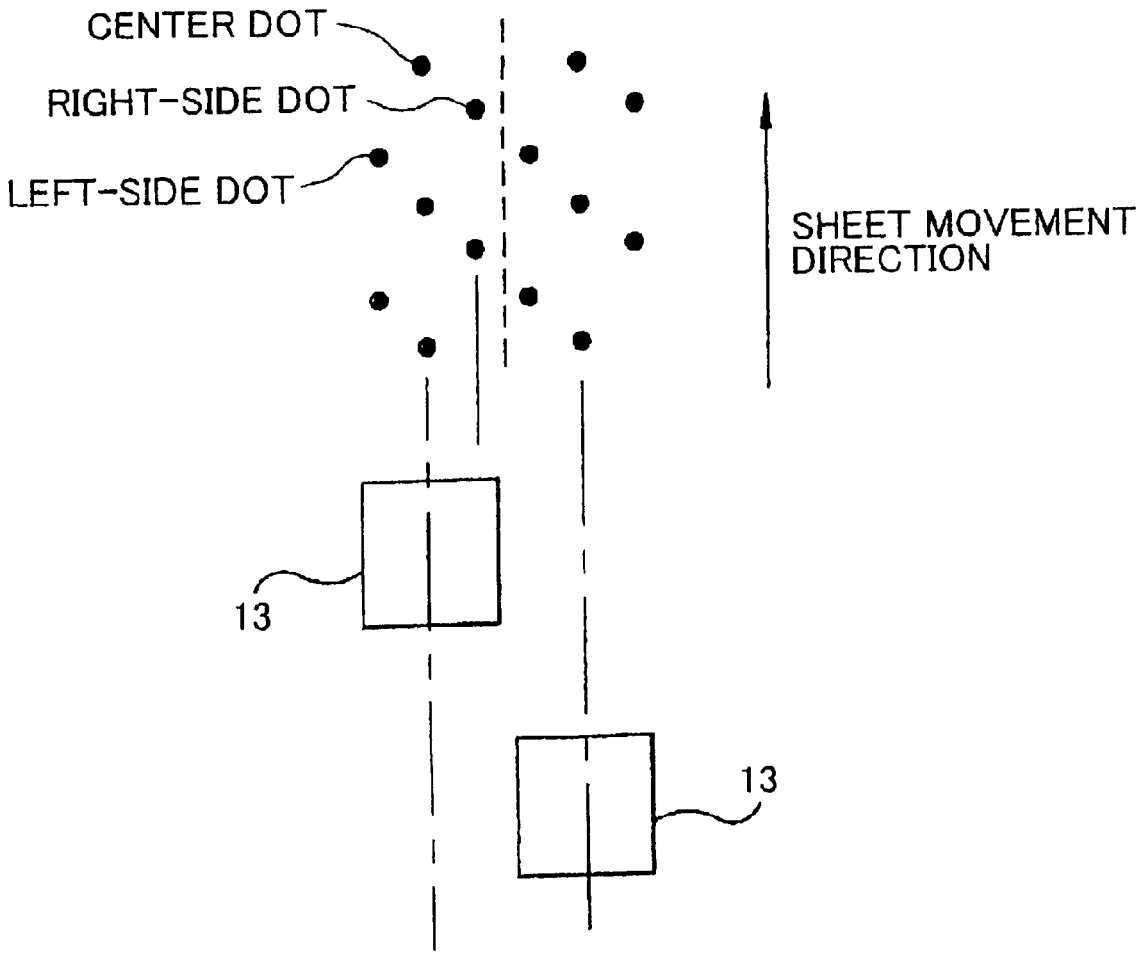
FIG. 2 is a view showing a dot pattern formed by the conventional ink jet head of FIG. 1.

Next, the present invention will be explained while referring to the drawings.

Figure 3:
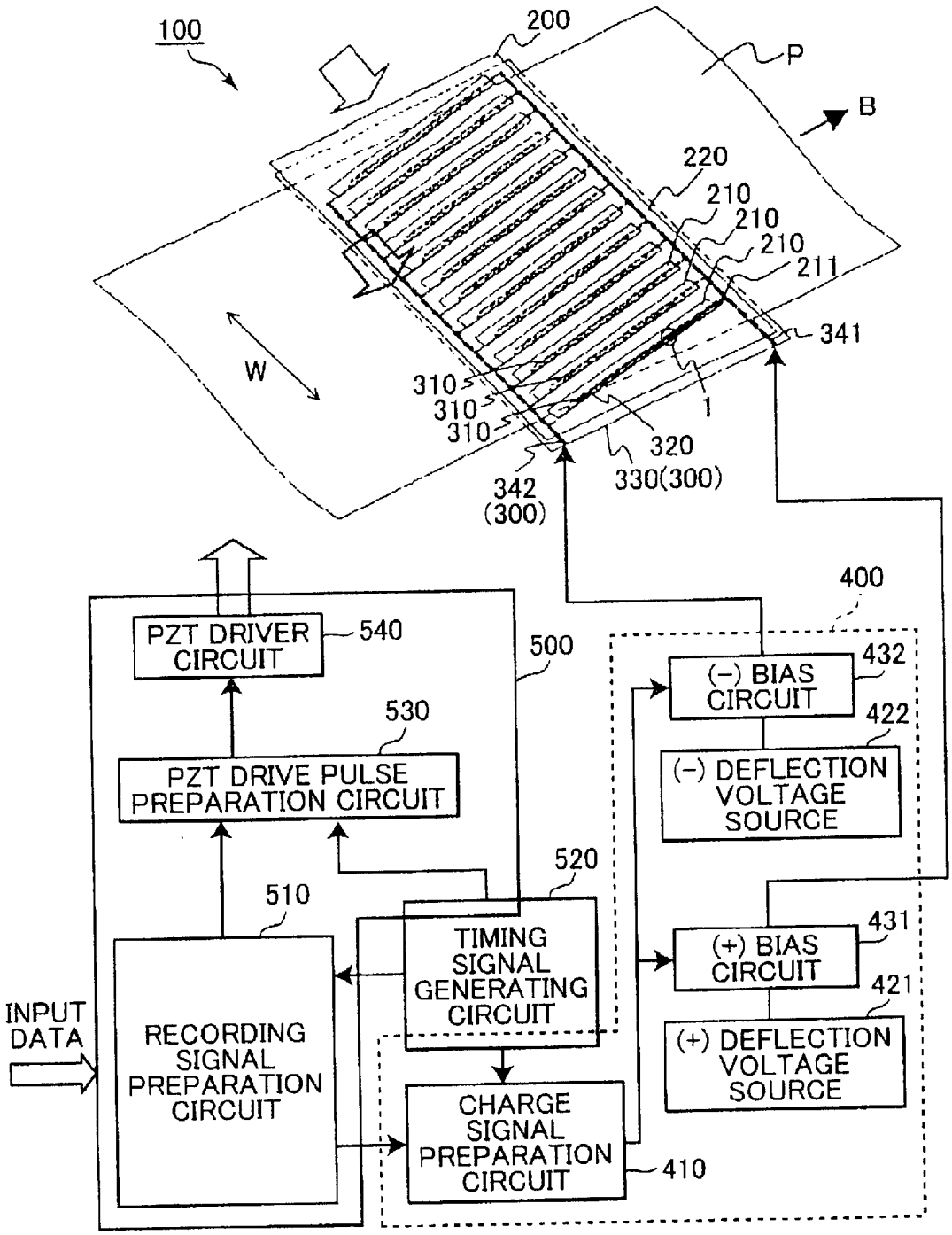
FIG. 3 is a structural diagram showing a line scan type ink jet recording device according to a first embodiment of the present invention.
Figure 4:
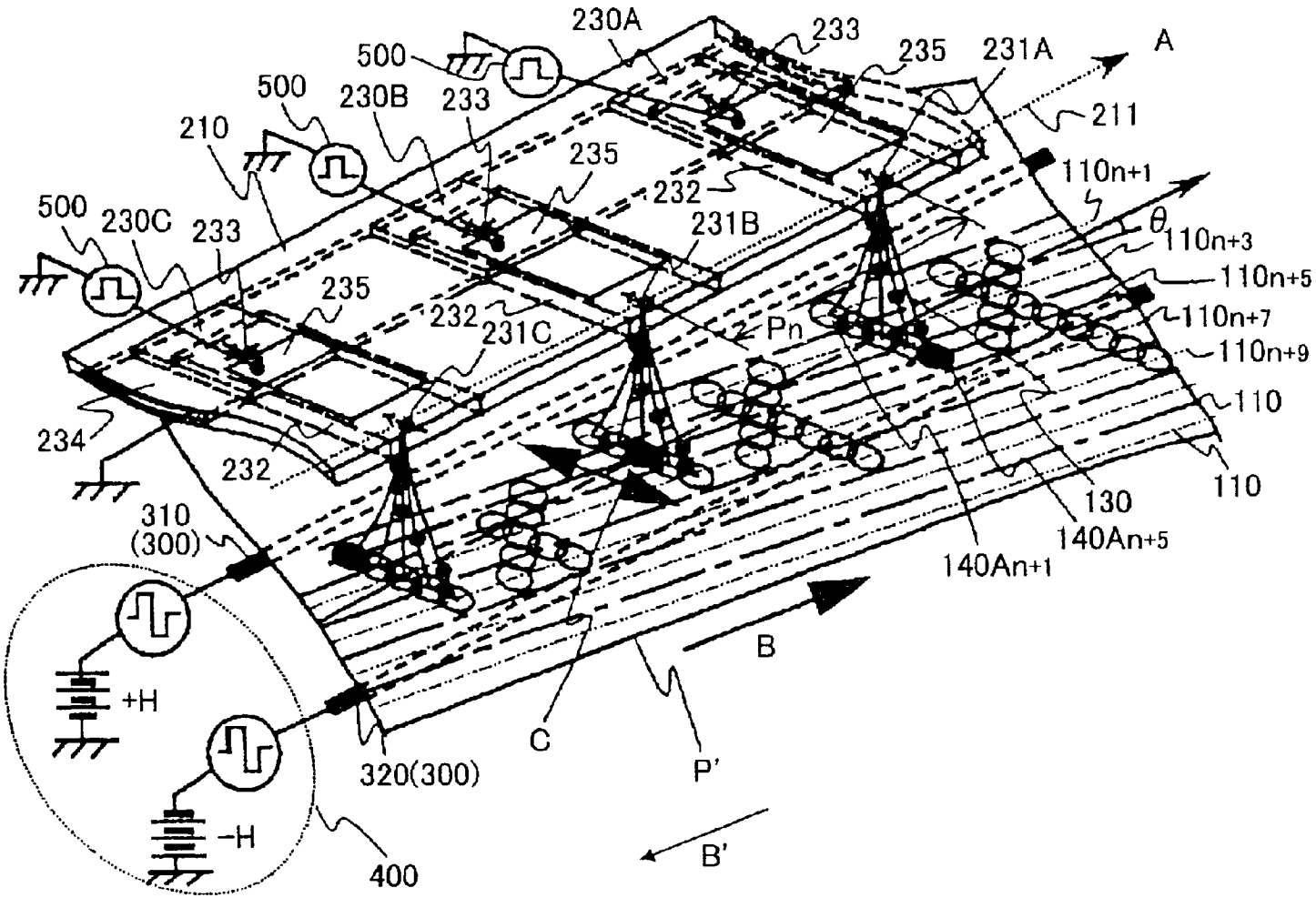
FIG. 4 is a magnified view of a recording portion of FIG. 3.

First, a line scan type ink jet recording device 100 according to a first embodiment of the present invention will be described with reference to FIGS. 3 to 9. FIG. 3 is a perspective view and a control block diagram showing configuration of the line scan type ink jet recording device 100. FIG. 4 is an enlarged partial view showing a recording region 1, which is encompassed in FIG. 3 by a circle, and is for explaining basic recording principles.

The line scan type ink jet recording device 100 is a device for high-speed recording of images with a fixed density (for example Ds=300 dpi) of main scan lines 110 on a consecutive recording sheet P (referred to a "recording sheet P" hereinafter) that is consecutively moved at a predetermined speed in a main scan direction indicated by arrow B in FIG. 3. The density of the main scan lines 110 indicates the number of main scan lines 110 per unit length in a width direction W of the recording sheet P.

As shown in FIG. 3, the line scan type ink jet recording device 100 includes a recording head 200, a rear-surface electrode body 300, a deflection control signal generation circuit 400, and an ink ejection control circuit 500.

The recording head 200 includes a plurality of linear recording head modules 210 and a frame 220 for supporting the plurality of recording head modules (referred to as "modules" hereinafter) in a predetermined positional relationship. The plurality of modules 210 have the same configuration.

As shown in FIG. 4, each module 210 includes a nozzle row 211 made from N-number of nozzles 230 arranged in a row. Each nozzle 230 is formed with a nozzle orifice 231. The nozzle pitch is Pn.

Each of the nozzles 230 has the same configuration and includes a nozzle orifice 231, an ink pressure chamber 232, an ink inflow orifice 233, a manifold 234, and a piezoelectric element 235. The nozzle orifice 231 is the open end of the ink pressure chamber 232. The ink inflow orifice 233 guides ink into the ink pressure chamber 232. The manifold 234 supplies ink into the ink inflow orifice 233. The piezoelectric element 235 is made from PZT, for example, and serves as an actuator. According to the present embodiment, PZT is used as the piezoelectric element 235. The PZT 235 is attached to the ink pressure chamber 232 and changes volume of the ink pressure chamber 232 in accordance with application of a recording signal.

The nozzle row direction A of the nozzle row 211 is an angle $\theta=\tan^{-1}(1/5)$, that is, about 11.3 degrees, with respect to the main scan direction B in which the main scan lines 110 extend. The nozzle pitch Pn is $2/300\ (\sin(1/5))^{-1}$ inch, that is, about 0.034 inches. Also, the number of nozzles n is 96 (n=96).

As shown in FIG. 3, in the present embodiment thirteen modules 210 are aligned in a width direction W of the recording sheet P so as to cover a widthwise recording region of the recording sheet P. The thirteen modules 210 are fisted to the frame 220. The width direction W is perpendicular to the main scan direction B. The recording head 200 confronts the surface of the recording sheet P so that the distance between the surface of the recording sheet P and each nozzle orifice 231 is a predetermined gap of, for example 1 mm to 2 mm. With this nozzle arrangement, the nozzle pitch in the width direction W of the recording head 200 can be set to 2/300 inch and the pitch Pn between nozzles that are adjacent in the main scan direction B can be set to 10/300 inch, so that the nozzle orifices 231 can be set in correspondence for every other main scan lines 110 in the width direction W.

The rear-surface electrode body 300 is configured from plural pairs of positive-polarity deflection electrodes 310 and negative-polarity deflection electrodes 320, an electrode arrangement substrate 330, a positive-polarity deflection electrode terminal 341, a negative-polarity deflection electrode terminal 342, and the deflection control signal generation circuit 400.

Figure 5:
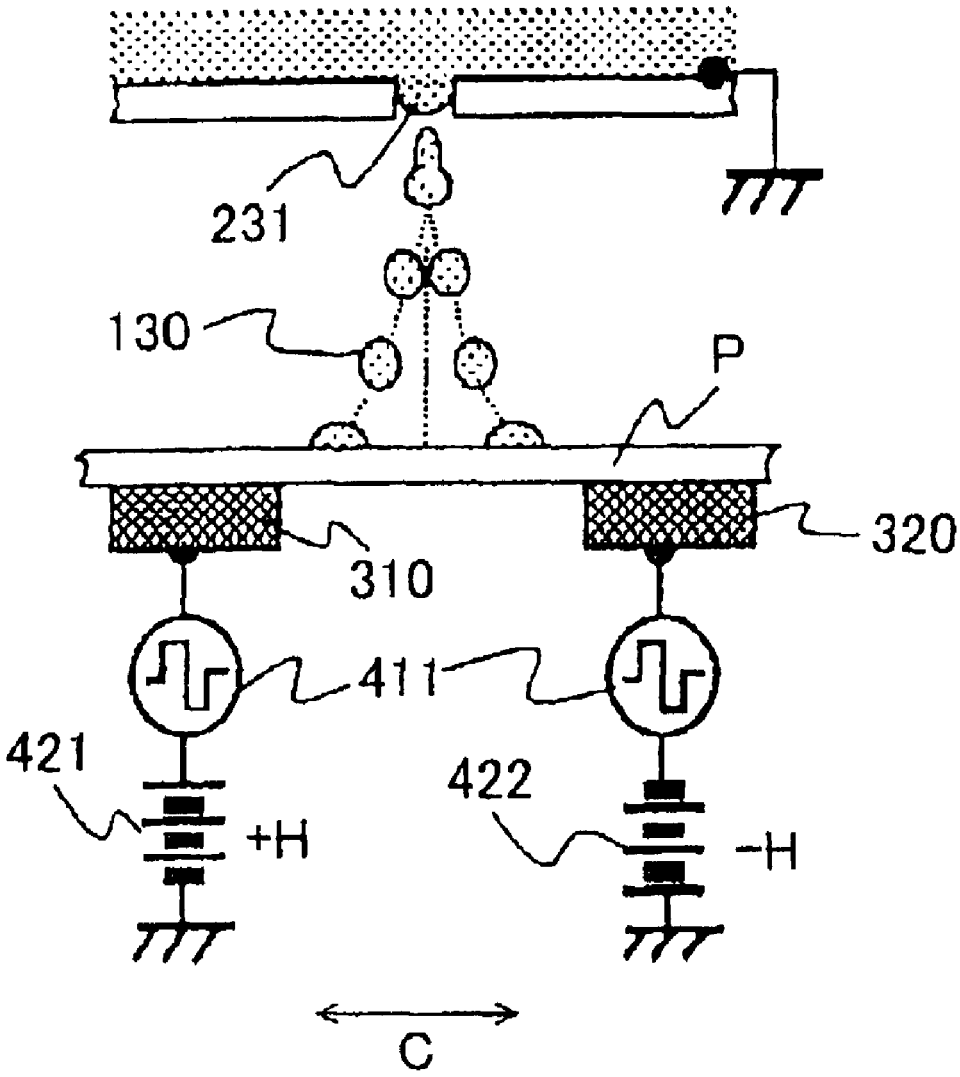
FIG. 5 is a view showing arrangement of deflection electrodes in the line scan type ink jet recording device of FIG. 3.

As shown in FIGS. 3 to 5, the plural pairs of positive-polarity deflection electrodes 310 and negative-polarity deflection electrodes 320 are disposed at the rear surface of the recording sheet P at positions sandwiching the nozzle rows 211. Electrodes with the same polarity are connected together on the electrode arrangement substrate 330 and connected to the corresponding one of the positive-polarity deflection electrode terminal 341 and the negative-polarity deflection electrode terminal 342.

The deflection control signal generation circuit 400 includes a charge signal preparation circuit 410, a positive-polarity deflection voltage source 421, a negative-polarity deflection voltage source 422, a positive-polarity bias circuit 431, and a negative-polarity bias circuit 432. The charge signal preparation circuit 410 generates a charge signal. The positive-polarity deflection voltage source 421 and the negative-polarity deflection voltage source 422 generate deflection voltages. The positive-polarity bias circuit 431 superimposes the signal voltage from the charge signal preparation circuit 410 on the deflection voltage from the positive-polarity deflection voltage source 421 to generate a deflection control signal voltage. The deflection control signal voltage is applied to the positive-polarity deflection electrodes 310 as a charge/deflection signal (A) shown in FIG. 6. Also, the negative-polarity bias circuit 432 superimposes a signal voltage from the charge signal preparation circuit 410 onto the deflection voltage from the negative-polarity deflection voltage source 422 to generate a deflection control signal voltage. The deflection control signal is applied to the negative-polarity deflection electrodes 320 as a charge/deflection signal (B) shown in FIG. 6.

The ink-droplet ejection control circuit 500 has a recording signal preparation circuit 510, a timing signal generation circuit 520, a PZT drive pulse preparation circuit 530, and a PZT driver circuit 540. The recording signal preparation circuit 510 prepares pixel data of an image based on input data, and the timing signal generation circuit 520 generates a timing signal. The PZT drive pulse preparation circuit 530 generates a drive pulse for the PZT 235 of each nozzle 230 based on the pixel data from the recording signal preparation circuit 510 and the timing signal from the timing signal generation circuit 520. The PZT driver circuit 540 amplifies the drive pulse to a signal level sufficient for driving the PZT 235. The drive pulse from the PZT driver circuit 540 is applied to the PZT 235 of each of the nozzles 230 as a PZT drive signal to eject ink droplets at a predetermined timing.

Figure 6:
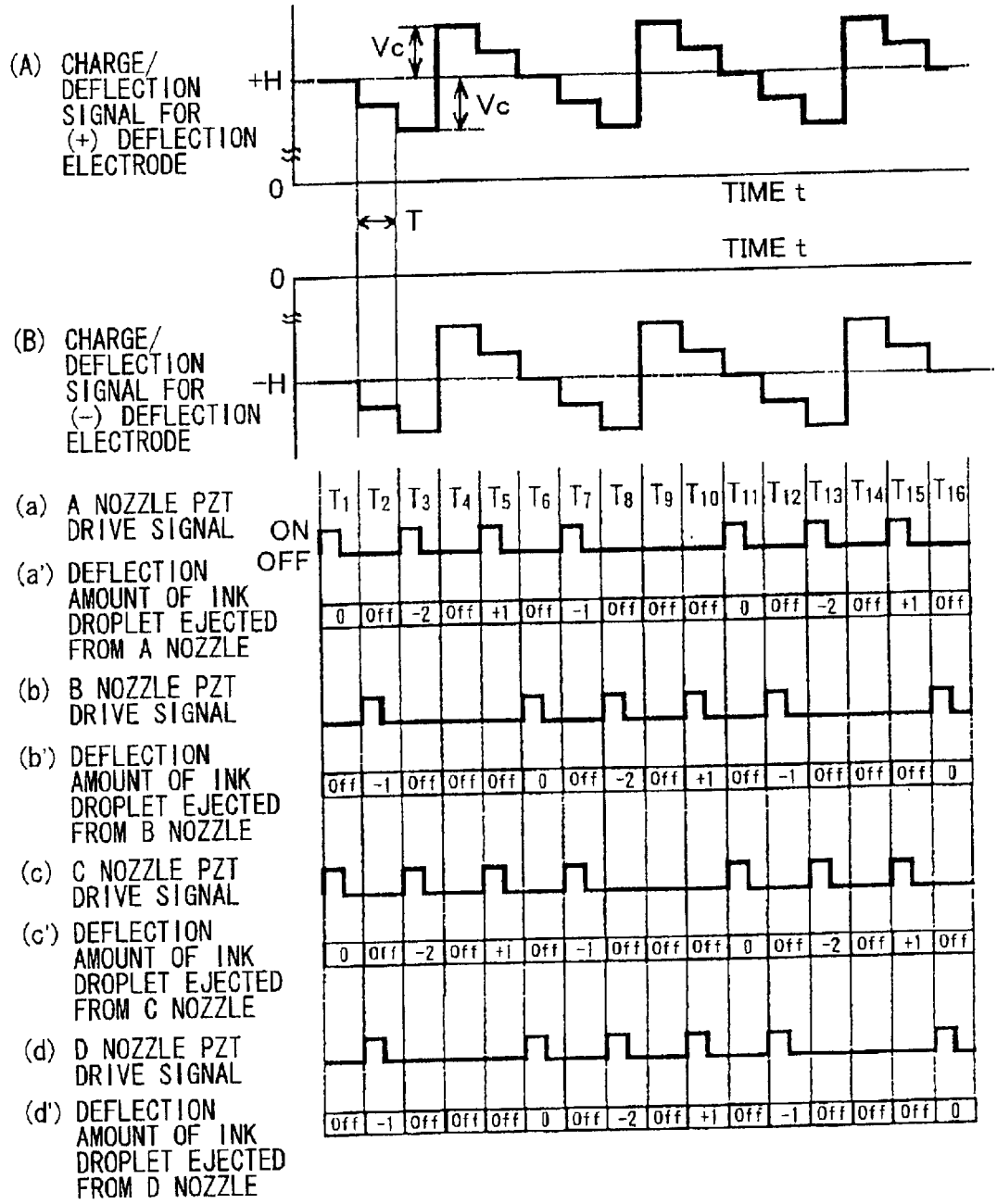
FIG. 6 is a view for explaining operation of the line scan type ink jet recording device of FIG. 3.
Figure 7:
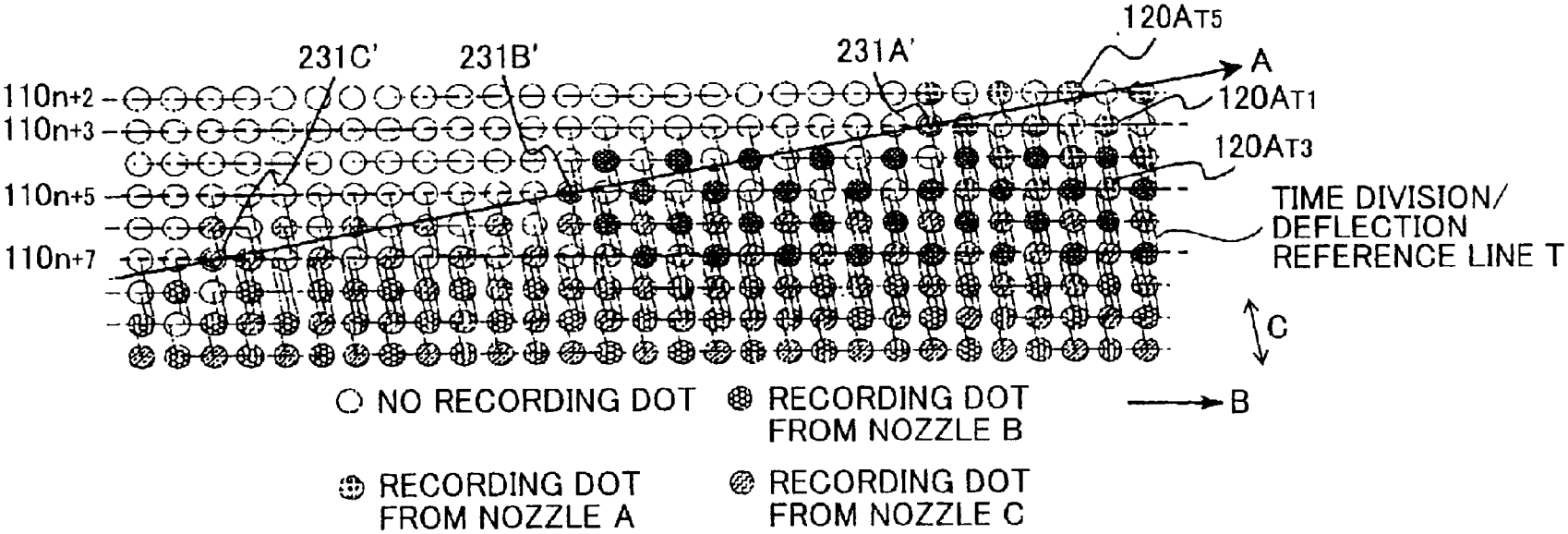
FIG. 7 is a view showing recording dot formation by the recording operations of FIG. 6.

FIG. 6 is a timing chart showing the charge/deflection signals (A), (B), a PZT drive signal (a) to (d) for each of the nozzles, and a deflection amount (a') to (d') for each of the ink droplets for the case when a recording sheet is printed completely black, that is, when a recording dot is formed on all of the pixels. FIG. 7 is a drawing showing recording dot formation of FIG. 6.

Next, a recording operation will be explained while referring to FIG. 6 and FIG. 7.

In FIG. 6, when the charge/deflection signals (A), (B) are applied to the charge/deflection electrodes 310, 320, then a +H deflection voltage is applied to the positive-polarity deflection electrodes 310 and a −H deflection voltage is applied to the negative-polarity deflection electrodes 320, and also a charge voltage is applied that changes by ½·VC for each time interval T between 0 and +/−VC. A deflection electrostatic field and a charge electric field are formed by application of these voltages.

On the other hand, the ink in the recording head 200 has a ground potential, that is, 0 potential. Accordingly, when the charge voltages are applied to the charge/deflection electrodes 310, 320, then a similar charge voltage is applied to the ink in the each nozzle orifice 231. When the conductivity of the ink is good, that is, at a few hundred ΩCm or less, then at the time of when an ink droplet 130 separates from the ink in the nozzle orifice 231, the ink droplet 130 is charged to a charge corresponding to the applied charge voltage and flies toward the recording sheet P. At this time, the charged ink droplet 130 is deflected in a deflection direction C indicated in FIG. 7 by the deflecting electrostatic field in accordance with the charge amount. The deflection direction C is perpendicular to the nozzle row direction A.

In FIG. 6, the charge amount of ejected ink droplets is 0 when the charge voltage is 0, and the deflection amount is +2, +1, −1, and −2, when the charge voltage is +VC, +½·VC, −½·VC, and −VC, respectively.

Using the above-described deflection control, ink droplets 130 ejected from a nozzle orifice 231A in FIG. 7 can impinge on main scan lines 110*n*+1 to 110*n*+5 so that recording dots 140An+1 to 140An+5 can be formed. Similarly, ink droplets 130 ejected from a nozzle orifice 231B can impinge on main scan lines 110*n*+3 to 110*n*+7, and ink droplets 130 ejected from a nozzle orifice 231C can impinge on main scan lines 110*n*+5 to 110*n*+9. Accordingly, recording is possible on the main scan line 110*n*+5 by ink droplets ejected from any of the three nozzle orifices 231A, 231B, and 231C. Recording is possible on the main scan line 110*n*+4 by ink droplets ejected from the two nozzle orifices 231A, 231B, and recording is possible on the main scan line 110*n*+6 by ink droplets ejected from the two nozzle orifices 231B, 231C. By this, even if, for example, nozzle 230B of the nozzle orifice 231B becomes defective so it cannot eject, the nozzles 230A, 230C, which have nozzle orifices 231A, 2310, can cover recording.

Next, recording operations will be explained for the PZT drive signal of FIGS. 6(*a*) to 6(*d*).

FIG. 7 shows the dot recording condition on the recording sheet P. The nozzle positions 231A', 231B', and 231C' are the projected positions on a recording sheet P of the nozzle orifices 231A, 231B, and 231C shown in FIG. 4.

In the present invention, recording is performed by combining ejection control, wherein ink droplets 130 are ejected from nozzle orifices 231 at a time interval T, with deflection control of the ejected ink droplets 130 while the recording sheet P is moved at a fixed speed in the main scan direction B.

In FIG. 7, during recording operations, nozzle 231B', for example, moves relative to the recording sheet P on the main scan line $\mathbf{110}_{n+5}$ in direction B', which is opposite from the main scan direction B. Here, in the drawings a plurality of time division/deflection reference lines T extend from the main scan line $\mathbf{110}_{n+5}$ in a deflection direction C at equidistant intervals with respect to the main scan direction B. The time division/deflection reference lines T extend with an equidistant interval opened therebetween in the main scan direction B. An ink droplet 130 is ejected from the nozzle orifice 231B for each time division/deflection reference line T. The length of the time division/deflection reference lines T represent the deflection amount. The ends of the time division/deflection reference lines T are positions where recording dots are formed. Accordingly, no recording dots are formed at the end of those time division/deflection reference lines T that extend from the nozzle position 231B' at a position where no ink droplet 130 is ejected.

Next, explanation will be focused on ejection of ink droplets from the nozzle orifice 231A.

Because the charge voltage of the charge/deflection signals (A), and (B) is zero and the PZT drive signal to the nozzle 230A is ON during the time period $T_1$ shown in FIG. 6, the ink droplet 130 ejected from the nozzle orifice 231A is uncharged, flies straight, and impinges on, for example, a pixel $\mathbf{120}_{T1}$ on the main scan line $\mathbf{110}_{n+3}$ of FIG. 7, thereby recording a recording dot $\mathbf{120}\mathrm{A}_{T1}$. The PZT drive signal to the nozzle 230A is OFF during the next time period T2, that is, the condition in FIG. 7 where the time division/deflection reference lines T has moved one line in the opposite direction B'. Therefore, no ink droplet is ejected and no recording dot is formed. Because the charge voltage is −VC and the PZT drive signal to the nozzle 230A is ON during the next time period T3, the ink droplet 130 ejected from the nozzle orifice 231A has a deflection amount of −2 and impinges at the position of the pixel $\mathbf{120}_{T3}$ on the main scan line $\mathbf{110}_{n+5}$ to form the recording dot $\mathbf{120}A_{T3}$. During T4, no recording dot is formed by the nozzle orifice 231An because the PZT drive signal to the nozzle 230A is OFF. Because the charge voltage is ½ VC and the PZT drive signal is ON during T5, the ink droplet 130 has a deflection amount of +1 and so impinges at the position of pixel $\mathbf{120}_{T5}$. By performing this recording operation for the other nozzles such as nozzles 231B, 231C, and 231D, the pixels are filled with recording dots in the manner shown in FIG. 7.

In this way, according to the present invention, ink droplets ejected from the plurality of nozzle orifices are controlled to impinge on or adjacent to the same main scan line with a single time main scan movement of the recording medium. The ejection timing of ink droplets, which are ejected from the plurality of nozzle orifices and which can be distributed on or near the same main scan line, is controlled so that recording dots formed by the ink droplets from different nozzle orifices are aligned in alternation with respect to the main scan direction and/or a direction perpendicular to the main scan direction. By this, it is possible to reduce recording distortion, such as density distortion and line distortion caused by variation in the size of recording dot due to the individual characteristics of the nozzles, and to overcome a major problem of conventional line scan type ink jet recording devices.

As can be understood from FIG. 7, in the present embodiment, charge/deflection control and ejection control of the ink droplets 130 are performed for each time division/deflection reference lines T, and the nozzle orifices are arranged so that recording can be performed by allotting ink droplets 130 to pixel positions that have an equidistant interval in the main scan direction B and in the width direction W. Therefore, there is no need to require a greater response from the recording head 200, or even a nozzle with the same frequency response is capable of higher speed printing. This control is possible because the nozzle orifices are in an appropriate arrangement in terms of nozzle pitch, an angle of the nozzle row with respect to the pixel positions, and the like.

A conventional recording device that uses the nozzles 231A, 231B, 231C was only capable of impinging recording dots on the three main scan lines $\mathbf{110}n_{+3}$, $\mathbf{110}n_{+5}$, $\mathbf{110}n_{+7}$. In contrast to this, the recording device according to the present invention is capable of forming dots on the intervening main scan lines. In other words, the nozzle number can be cut to ½ the conventional amount.

Figure 8:
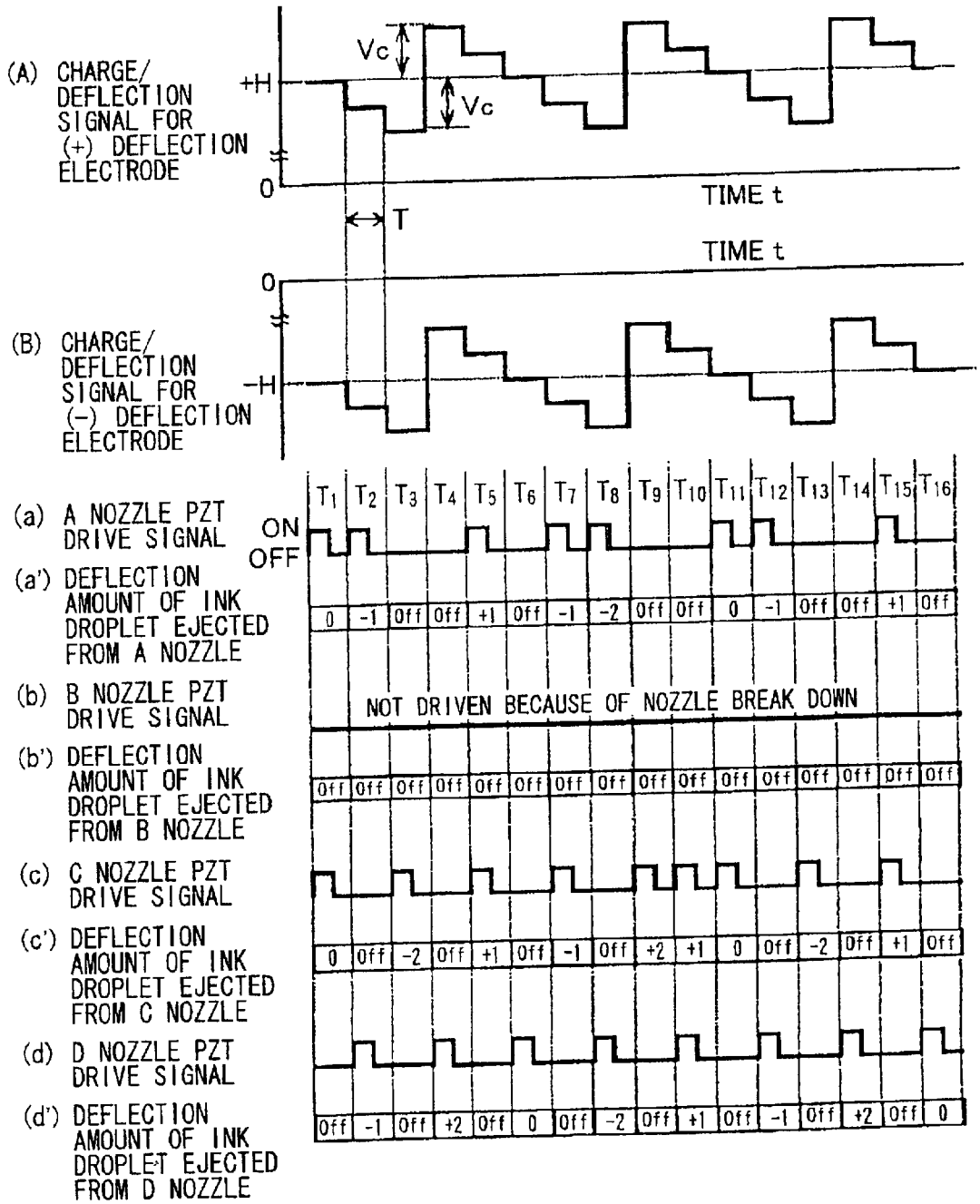
FIG. 8 is a view for explaining operations of the line scan type ink jet recording device of FIG. 3.
Figure 9:
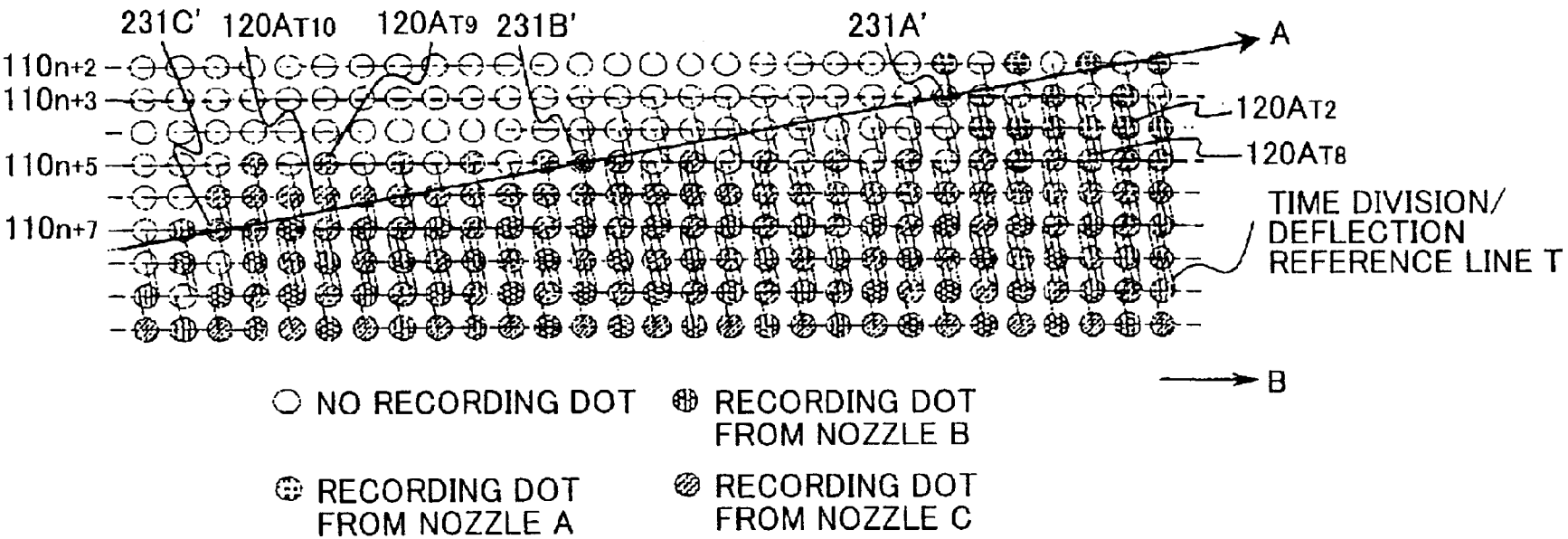
FIG. 9 is a view showing recording dot formation by the recording operations of FIG. 8.

FIG. 8 shows an example of operations to print a sheet completely black without using the nozzle 231B when the nozzle 231B breaks down. Compared with the normal printing operation of FIG. 6, the charge/deflection signals (A) (B) are the same, but the PZT drive signals (a) to (d) are different.

That is, no drive signal is applied to the nozzle 231B because the nozzle 231B is not used. That is, the nozzle 231B is constantly OFF. Instead, the ink droplet 130 ejected from the nozzle 231A is deflected by the deflection level −1 to impinge on the pixel positions, such as $\mathbf{120}A_{T2}$ shown in FIG. 9, and deflected by the deflection level −2 to impinge on the pixel positions, such as $\mathbf{120}A_{T8}$. Also, ink droplets 130 ejected from the nozzle 231C are deflected by the deflection level +2 to impinge on the pixel position $\mathbf{120}C_{T9}$ and the like, and deflected by the deflection level +1 to impinge on the pixel position $\mathbf{120}A_{T10}$ and the like. In this way, the nozzles 231A, 231C replace the nozzle 231B and record pixels that were assigned to the nozzle 231B. In this case also, the PZT drive signal applied to the nozzles 231 is set so that adjacent recording dots are recorded using different nozzles 231 as much as possible. By this, recording dots can be arranged on all of the pixel positions so that a function for backing up broken nozzles can be achieved.

Operations were explained for the case when a single nozzle breaks down. However, by making changes to the above-described operations as appropriate for the defective position, it is possible to back up a plurality of odd-numbered nozzles that break down at the same time or a plurality of even-numbered nozzles that break down at the same time.

Also, it is possible to cover for two consecutive nozzles that break down, by using the normal nozzles on either side. The deflection level and deflection amount of the ink droplets can be increased or the ink ejection response frequency of the nozzles can be enhanced in order to cope with three or more consecutive nozzles that break down.

Further, in the embodiment, a nozzle orifice was provided for every other single main scan line, thereby reducing the number of nozzles to one half. However, the percentage of reduction can be increased further by providing each nozzle orifices for each N-number of main scan lines. The angle of the nozzle row with respect to the main scan line and the nozzle pitch can be set to appropriate value. Also, the deflection means controls deflection amount so that an ink droplet can impinge on all of at least N-number of main scan lines. The timing of ink droplet ejection is controlled to enable ink droplets to impinge on or nearby all pixel positions on the main scan line. By this, it is possible to reduce the number of nozzles to 1/N. Reducing the number of nozzles prevents reduction in recording reliability that results from the increase in frequency of nozzle break down that is associated with increase in the number of nozzles. Also, by reducing the number of nozzles it is also possible to reduce the price of the head of the recording device, because the cost of the head is greatly influenced by the number of nozzles.

It is also possible to use the feature to reduce the number of nozzles to 1/N in the following manner. That is, recording can be N times more fine than a conventional configuration, even if the recording head has the same nozzle distribution pitch. Further, a recording device using the same recording head can perform higher-fineness recording without changing the arrangement of the head, but by merely changing the deflection and scan specifications.

The present invention provides a recording head with a broader nozzle pitch capable of recording in the same fineness, making easier to produce the recording head and enhancing recording quality by reducing fluctuation in ejection characteristic that accompanies interference between nozzles.

Next, a second embodiment of the present invention will be explained with reference to FIGS. 10 to 20. It should be noted that the similar configurations to the line scan ink jet recording device 100 of the previous embodiment will be assigned with the same reference numbers and their explanation will be omitted.

Figure 11:
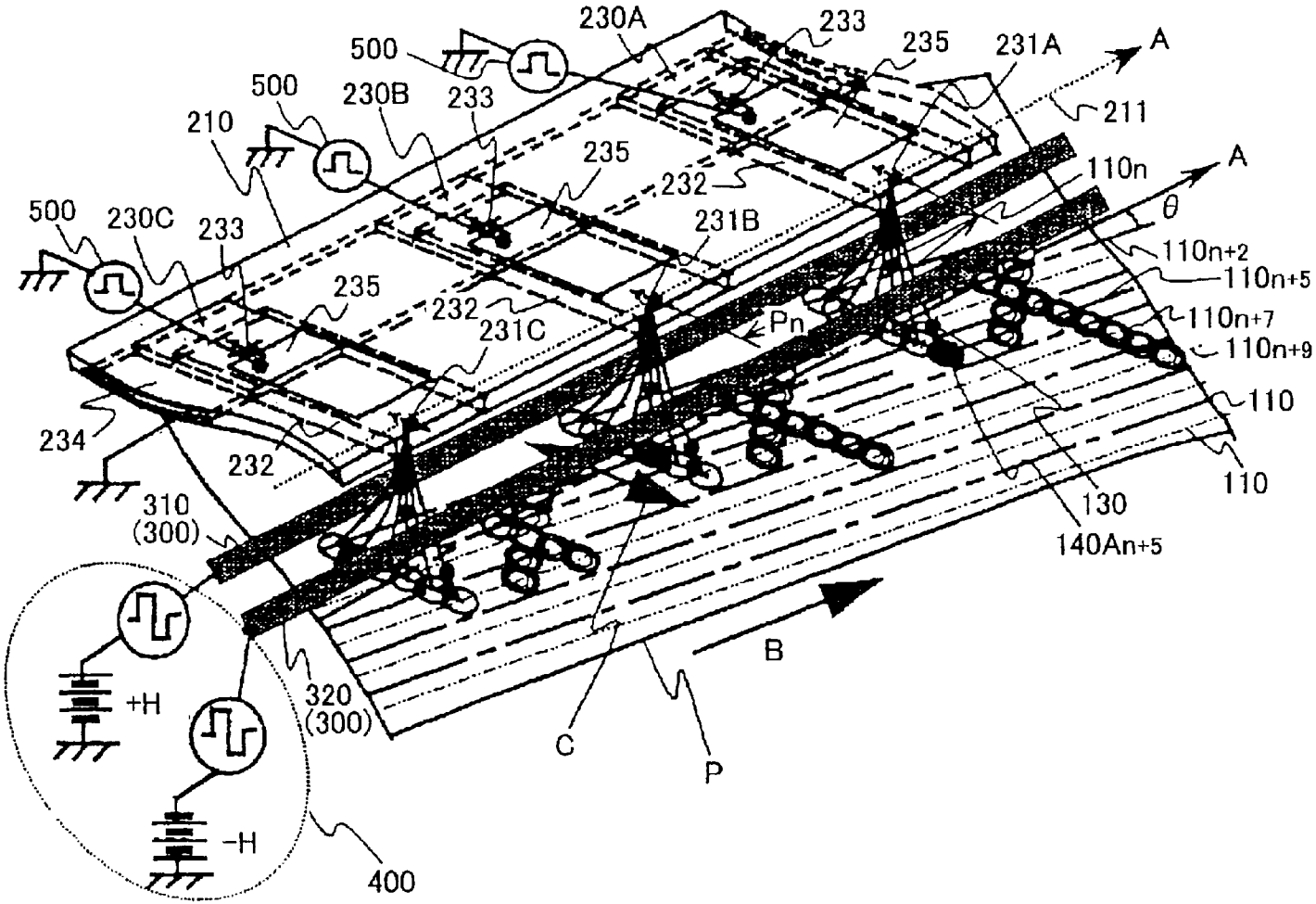
FIG. 11 is a magnified view of a recording portion of FIG. 10.

A line scan ink jet recording device 100A of the present embodiment is a device for recording images with a density Ds=300 dpi of main scan line 110 of FIG. 11 at high speeds on a recording sheet P that moves in the main scan direction B at a predetermined recording speed.

Figure 10:
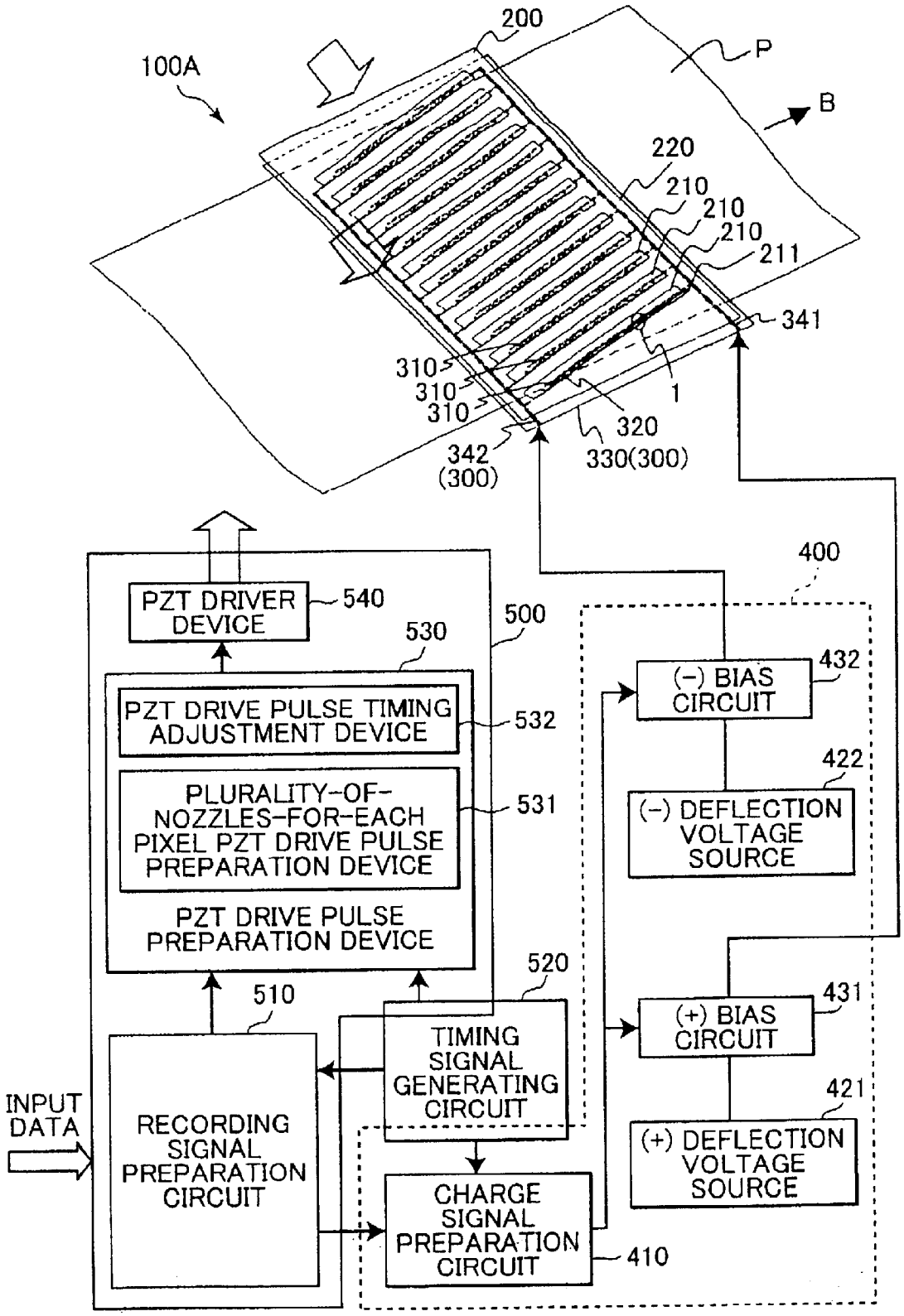
FIG. 10 is a perspective view and a block diagram of an ink jet recording device according to a second embodiment of the present invention.

As shown in FIG. 10, the line scan ink jet recording device 100A includes a recording head 200, an intermediate electrode 300, a deflection control signal generation circuit 400, and an ink droplet ejection control circuit 500.

The recording head 200 differs from the recording head 200 of the first embodiment in that the nozzle row direction A is set at an angle $\theta=\tan^{-1}(1/6)$, that is, about 9.46 degrees, with respect to the main scan direction B and that the nozzle pitch Pn is $2/300\ (\sin(1/6))^{-1}$ inch, that is, about 0.04 inches. n is 96. Also, the nozzle pitch is set to $2/300$ inch in the width direction W and the nozzle pitch is set to $12/300$ inch in the main scan direction B. One nozzle orifice 231 is provided for every other main scan line 110.

Figure 12:
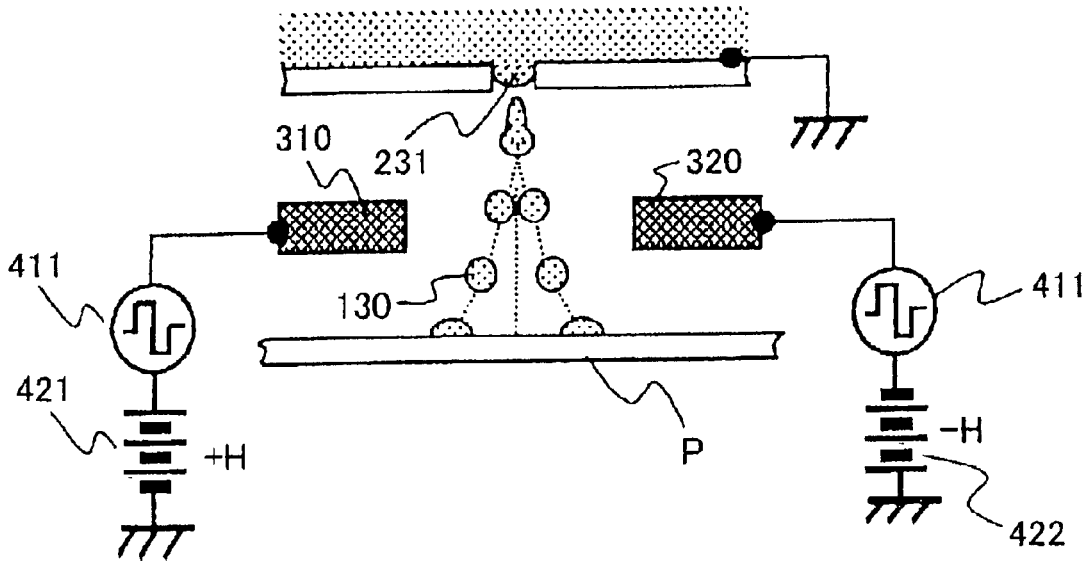
FIG. 12 is a view showing deflection electrode arrangement of the line scan type ink jet recording device of FIG. 10.

As shown in FIGS. 11 and 12, the plural pairs of positive-polarity deflection electrodes 310 and negative-polarity deflection electrodes 320 of the intermediate electrode body 300 are disposed between the recording sheet P and the recording head 200 at positions that sandwich the nozzle row of corresponding linear head recording modules 210 of the recording head 200. Each set of same-polarity electrodes are arranged in a group on the electrode arrangement substrate 330 and connected to corresponding one of the positive-polarity deflection electrode terminal 341 and the negative-polarity deflection electrode terminal 342. A charge/deflection signal (A) (B) (FIG. 13) from the deflection control signal generation circuit 400 is applied to the electrodes 320, 321. Here, according to the previous embodiment, the charge/deflection electrodes 310, 320 are disposed to the rear side of the recording sheet P. Although this configuration is very resistant to the problem of electrode contamination by ink mist, the electrical characteristics of the recording sheet P sometimes undesirably change deflection amount. To avoid this, the charge/deflection electrodes 310, 320 of the present embodiment are disposed above the surface of the recording sheet P. With this configuration, the deflection amount of the ink droplets can be stabilized without being influenced by the characteristics of the recording sheet P. Also, because the charge/deflection electrodes 310, 320 is located nearer to the nozzle orifices 231, the deflection sensitivity of the ink droplets can be increased and the charge/deflection voltage can be greatly reduced. Problems with respect to ink mist can be reduced by using, as the electrode material, a plate material and the like hardened with conductive fibers such as stainless steel fibers.

The PZT drive pulse preparation device 530 of the ink ejection control circuit 500 includes a PZT drive pulse generation device 531 for plural nozzles for each pixel and a PZT drive pulse timing adjustment device 532. The PZT drive pulse generation device 531 for a plural nozzles for each pixel generates a PZT drive pulse signal. The PZT drive pulse signal is applied to the PZTs of the nozzles to eject ink droplets from the nozzles. In this example, a PZT drive pulse signal is generated so as to eject a plurality of ink droplets from the different nozzles to impinge on the same pixel position to form a single recording dot. The PZT drive pulse timing adjustment device 532 is for adjusting timing of the PZT drive pulse signal. Here, adjustments are made so that ink droplets ejected from a plurality of nozzles according to the PZT drive pulse signal impinge on or near the pixel positions and form a single pixel.

Figure 13:
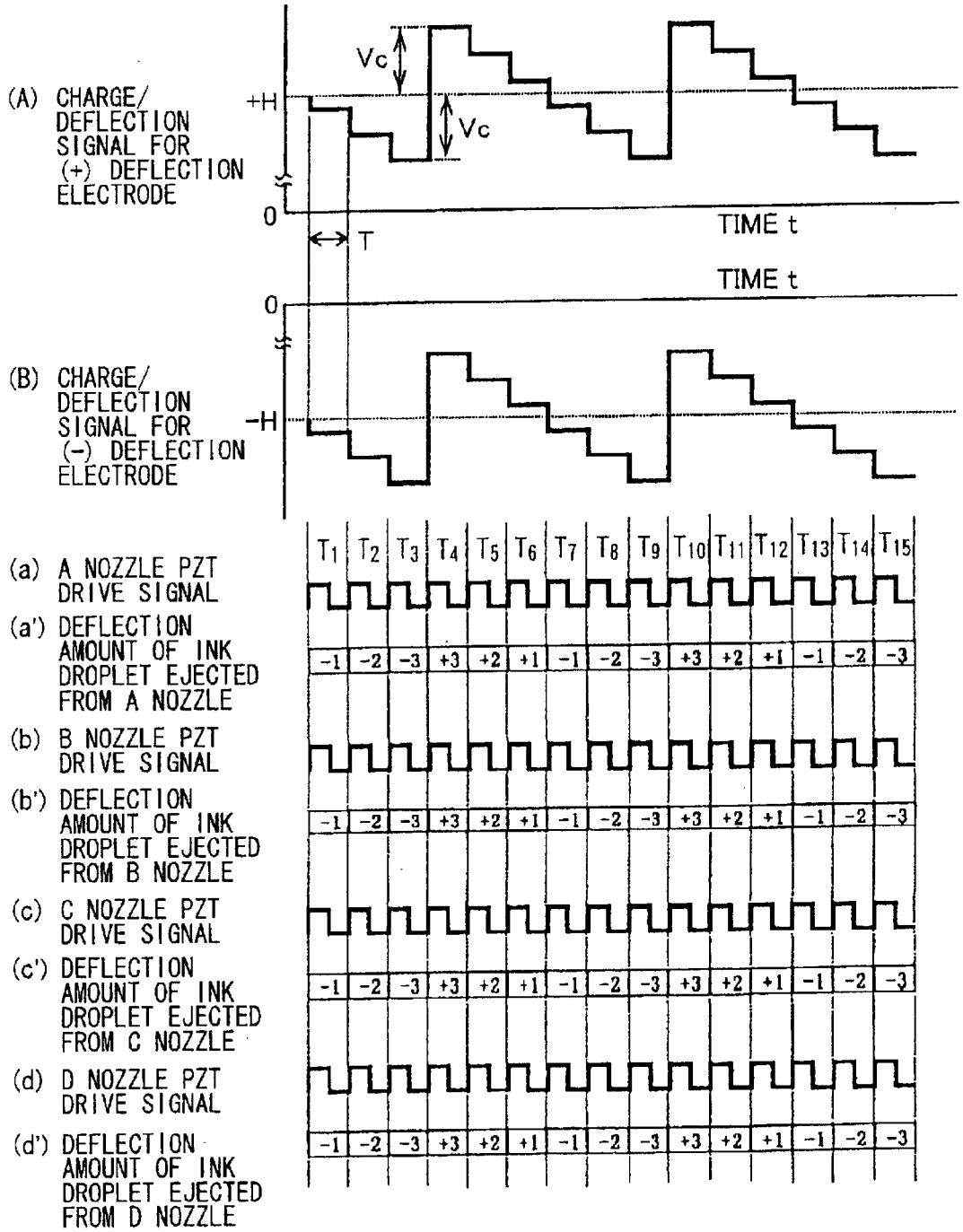
FIG. 13 is a timing chart showing control of the ink jet recording device of FIG. 10.
Figure 14:
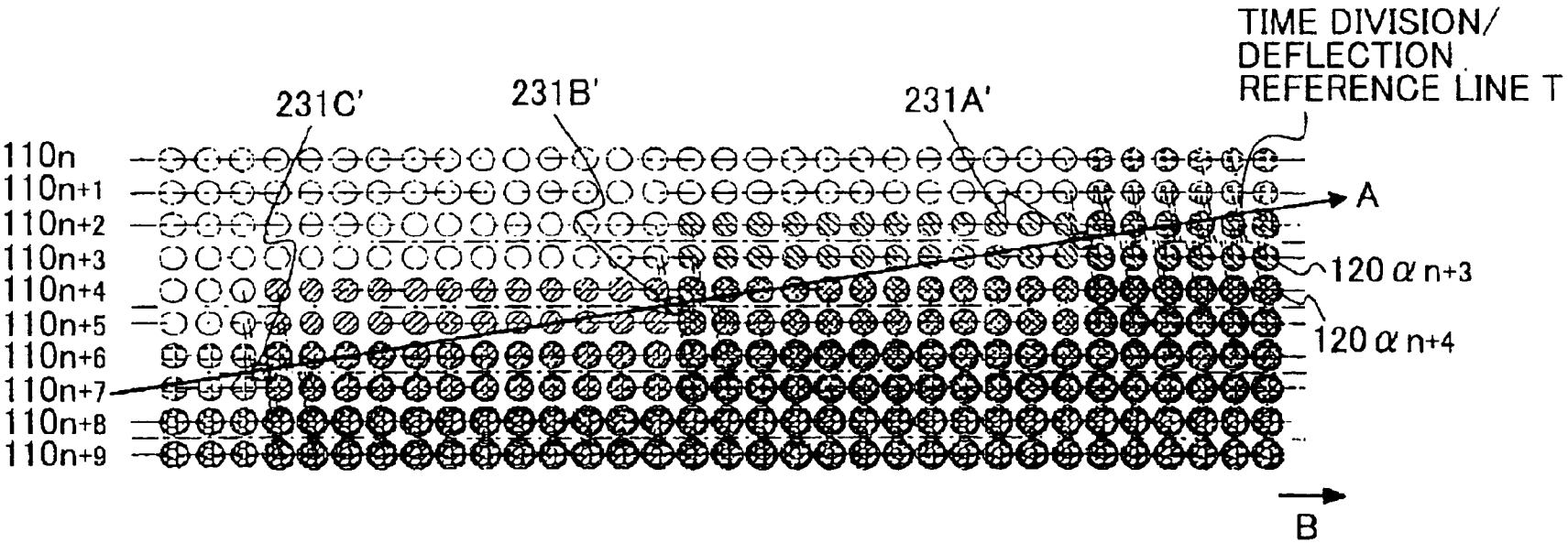
FIG. 14 is a view showing recording dot formation by the recording operation of FIG. 13.

FIG. 13 is a timing chart showing the charge/defection signals (A) (B) that are applied to the charge/deflection electrodes 310, 320, the PZT drive signals (a) to (d) for each nozzle, the deflecting amount (a') to (d') of each ink droplet for when printing a recording sheet totally in black, that is, when recording dots are formed on all of the pixels. FIG. 14 is a view showing condition of recording dot formation.

Next, a recording operation will be explained while referring to FIGS. 11, 13, and 14.

When the charge/defection signal (A) (B) is applied to the charge/deflection electrodes 310, 320, then as shown in FIG. 13 a deflection voltage +H is applied to the positive electrode 310 and a deflection voltage −H is applied to the negative electrode 320. Also, a charge voltage that changes between 0 to +/−VC is applied. The charge voltage changes by $1/5 \cdot VC$ for each time interval T. By applying voltage in this manner, a deflection electrostatic field and a charge electric field are formed. On the other hand, the voltage of the ink in the recording head 200 is ground potential, that is, 0 potential. Accordingly, the above-described charge voltages are applied to the ink droplets 130 ejected from the nozzle orifice 231 and to the charge/deflection electrodes 310, 320. When the conductivity of the ink is good, that is, at a few hundred ΩCm or less, then at the time of when an ink droplet 130 separates from the ink in the nozzle orifice 231, the ink droplet 130 is charged to a charge corresponding to the applied charge voltage and then flies toward the recording sheet P. At this time, the charged ink droplet 130 is deflected in a deflection direction C by the deflecting electrostatic field in accordance with the charge amount.

In FIG. 11, the ink droplets 130 ejected from the nozzle orifice 231A can, by being deflected, impinge on the main scan lines 110*n* to 110*n*+5 and can form recording dots 140An to 140*n*+5. In the same way, ink droplets ejected from the nozzle orifice 231B can, by being deflected, impinge on the main scan lines 110*n*+2 to 110*n*+7, and ink droplets ejected from the nozzle orifice 231C can, by being deflected, impinge on the main scan lines 110*n*+4 to 110*n*+9. Accordingly, recording dot can be formed at the pixel positions on the main scan line 110*n*+5 by ejecting ink droplets from any of the three nozzle orifices 231A, 231B, and 231C. Also, in the same way, recording dots can be formed on pixel positions on all of the other main scan lines by ink droplets from different three nozzle orifices.

Next, recording operations when the PZT drive signal is as in (a) to (d) of FIG. 13 will be explained focusing on ink droplets ejected from the nozzle orifice 231A.

Because the charge voltage is $-1/5$ VC during the time period $T_1$ of FIG. 13 as shown in (a), the ink droplet that was ejected by applying a PZT drive signal pulse to the PZT of the nozzle 231A forms a recording dot by impinging on, for example, the pixel $\mathbf{120}\alpha_{n+3}$ on the main scan line $\mathbf{110}_{n+3}$ of FIG. 14. Because as shown in (a) the charge voltage is $-3/5 \cdot VC$ in the successive time period T2, the ink droplet that was ejected by applying a PZT drive signal pulse to the PZT of nozzle 231A forms a recording dot by impinging on, for example, the pixel $\mathbf{120}\alpha_{n+4}$ on the main scan line $\mathbf{110}_{n+4}$ of FIG. 14. In the same way, recording dots can be formed on the main scan lines 110*n* to $\mathbf{110}_{n+5}$ by impinging ink droplets 130 at all six lines' worth of pixel positions by serially distributing ink droplets that were ejected from the nozzle 231A.

Also, the other nozzles 231, such as the nozzles 231B, 231C, can form recording dots on all pixel positions of the corresponding six main scan lines 110 in the same manner. Accordingly, after a recording dot is formed on, for example, the pixel position $\mathbf{120}\alpha_{n+4}$ by an ink droplet 130 that was ejected from the nozzle 231C, then, after scanning, a recording dot is formed on the pixel position $\mathbf{120}\alpha_{n+4}$ by the nozzle 231B and then by the nozzle 231A. One ink droplet 130 is ejected from each of three adjacent nozzles while the scanning progresses so that a total of three ink droplets 130 impinge on each of the other pixels, and the recording sheet can be printed completely black in the end.

Figure 15:
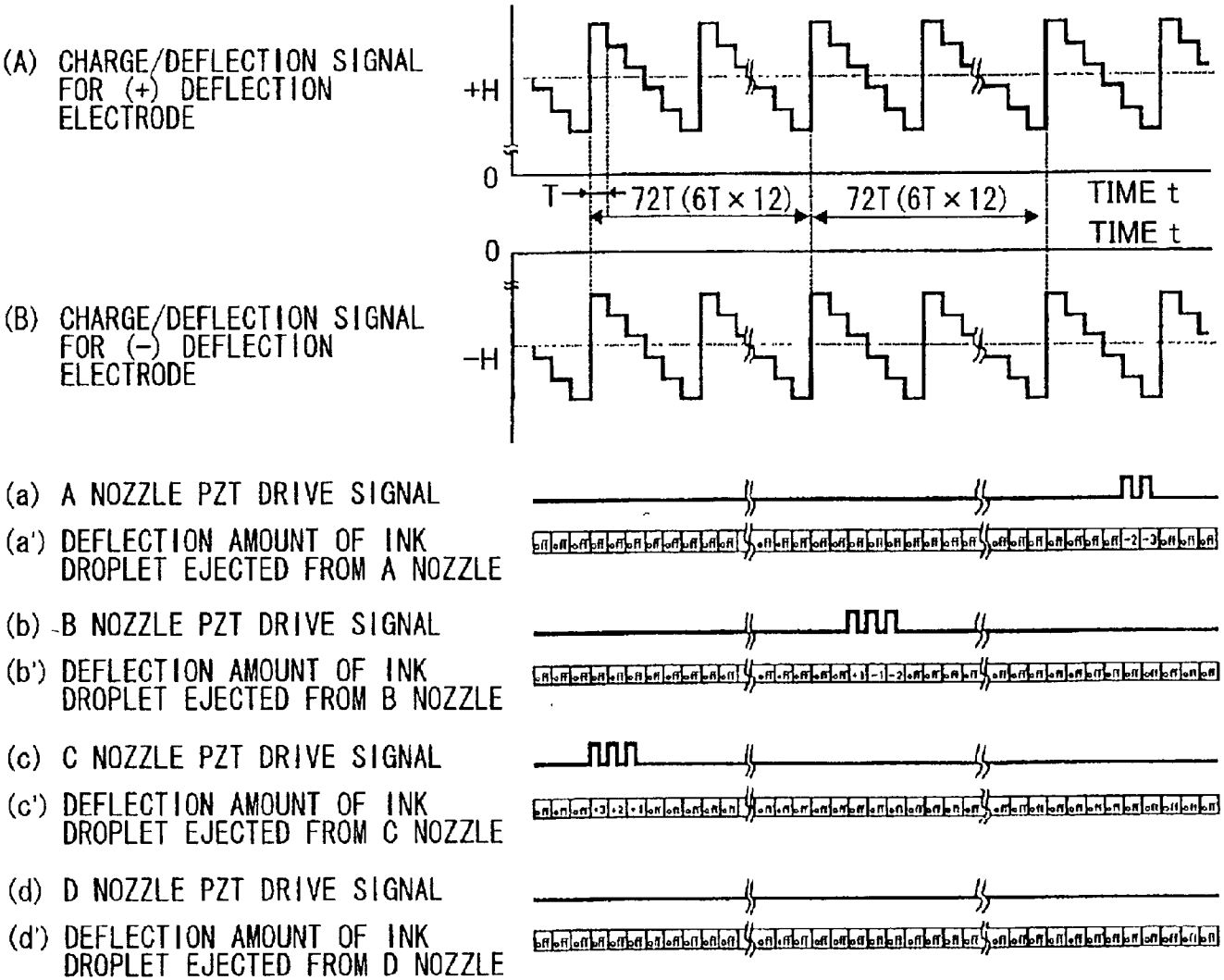
FIG. 15 is a timing chart showing control of the ink jet recording device shown in FIG. 10.
Figure 16:
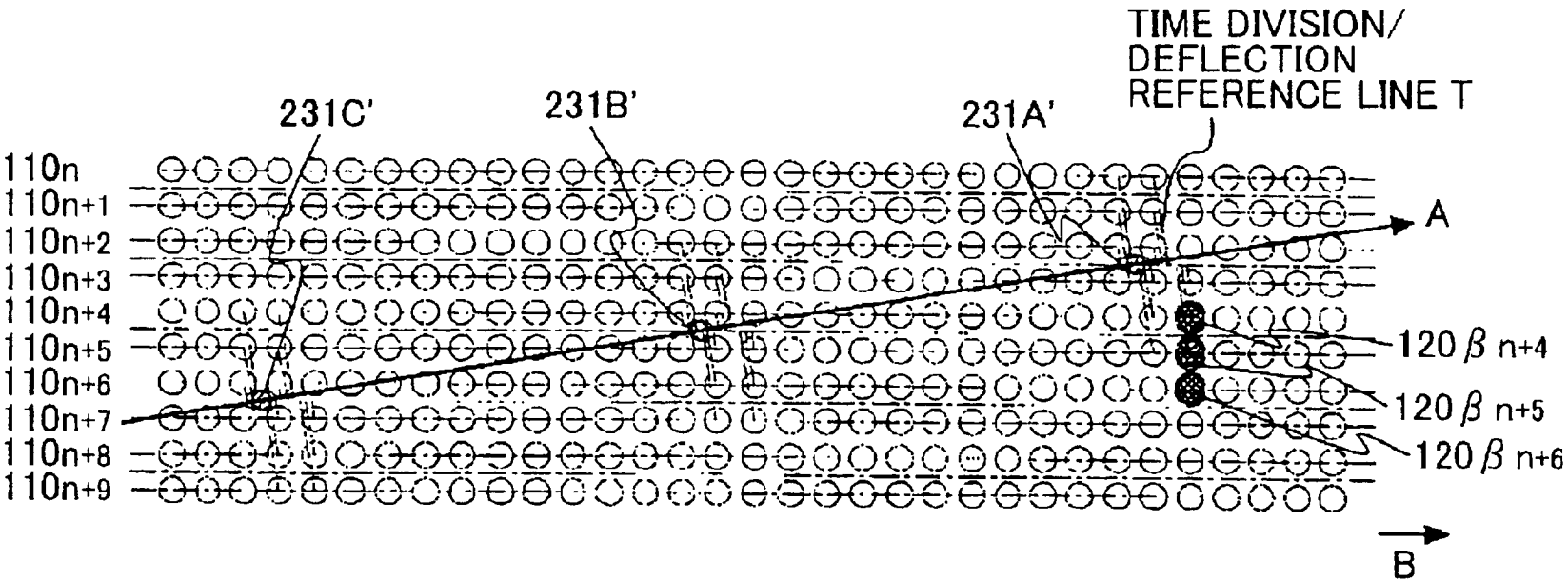
FIG. 16 is a view showing recording dot formation by the recording operations of FIG. 15.

FIG. 15 is a timing chart showing a control method for controlling the charge/defection signals (A) (B), the PZT drive signals (a) to (d) for each nozzle, and the deflecting amount (a') to (d') of each ink droplet are for when printing a short-line pattern, which is an example of printing an optional recording pattern, on a recording sheet P. FIG. 16 is a view showing condition of recording dot formation. The recording operations will be described below. It should be noted that in the present example a short-line pattern is printed from three pixels 120$\beta_{n+4}$, 120$\beta_{n+5}$, and 120$\beta_{n+6}$ as shown in FIG. 16.

First, by moving the recording sheet P and the recording head 200 relative to each other in a scan direction, an ink droplet ejected from a nozzle 231D (not shown), which is disposed adjacent (that is, to the left in FIG. 11) to the nozzle 231C, impinges on pixel element 120$\beta_{n+6}$ and forms a recording dot. Next, three ink droplets 130 are ejected in succession from the nozzle 231C in response to three PZT drive pulses shown in FIG. 15(C). At this time, because deflection control signal voltages shown in FIG. 15(A) and (B) are applied to the charge/deflection electrodes 310, 320, the ejected ink droplets 130 are deflected by levels +3, +2, and +1, respectively, and impinge on the pixel positions 120$\beta_{n+2}$, 120$\beta_{n+5}$, and 120$\beta_{n+6}$. Following this, after 74T, three ink droplets 130 are ejected in succession from nozzle 231B in response to the three PZT drive pulses shown in FIG. 15(B). These three ink droplets 130 are deflected by levels +1, −1, and =2, and impinge on the pixel positions 120$\beta_{n+4}$, 120$\beta_{n+5}$, and 120$\beta_{n+6}$, respectively. In the same way, two ink droplets from the nozzle 231A impinge on the pixel positions 120$\beta_{n+4}$, 120$\beta_{n+5}$. Afterward, the ink droplet 130 from the nozzle located right to the nozzle 231A impinges on the pixel position 120$\beta_{n+4}$.

As described above, the ink droplets 130 ejected from the nozzles 230 of the recording head 200 are deflected in a deflection direction C having a direction component that is at right angles with the main scan direction B so that the ink droplets 130 can impinge on any one of a plurality of predetermined main scan line 110. Also, the recording head 200 moves relative to the recording sheet P in the main scan direction. With this configuration, ink droplets 130 ejected from a plurality of nozzle orifices 231 can impinge on or near the same main scan line 110.

Also, the nozzle orifices can form dots at a predetermined interval on the recording sheet by the deflecting control means and by a single scan movement of the recording head relative to the recording sheet. Also, a nozzle pitch in the nozzle row direction and a tilting angle of the nozzle line with respect to the main scan direction are set to enable ink droplets, that were ejected from a plurality of nozzle orifices and deflected so as to impinge on or near the same scan line, to impinge on or near the same pixel position.

Further, when recording dots are to be formed on or near a predetermined pixel on a recording sheet, the ink droplet ejection control means controls ejection timing of ink droplets from a plurality of nozzle orifices, which are allocated for recording on each pixel, to form dots on a single pixel. The ejection timing is determined by the arrangement of the nozzle orifices, the deflection control means, and the main scan movement. By controlling in this way, ink droplets ejected from a plurality of nozzles impinge on or near pixel positions to form a single pixel.

Figure 17:
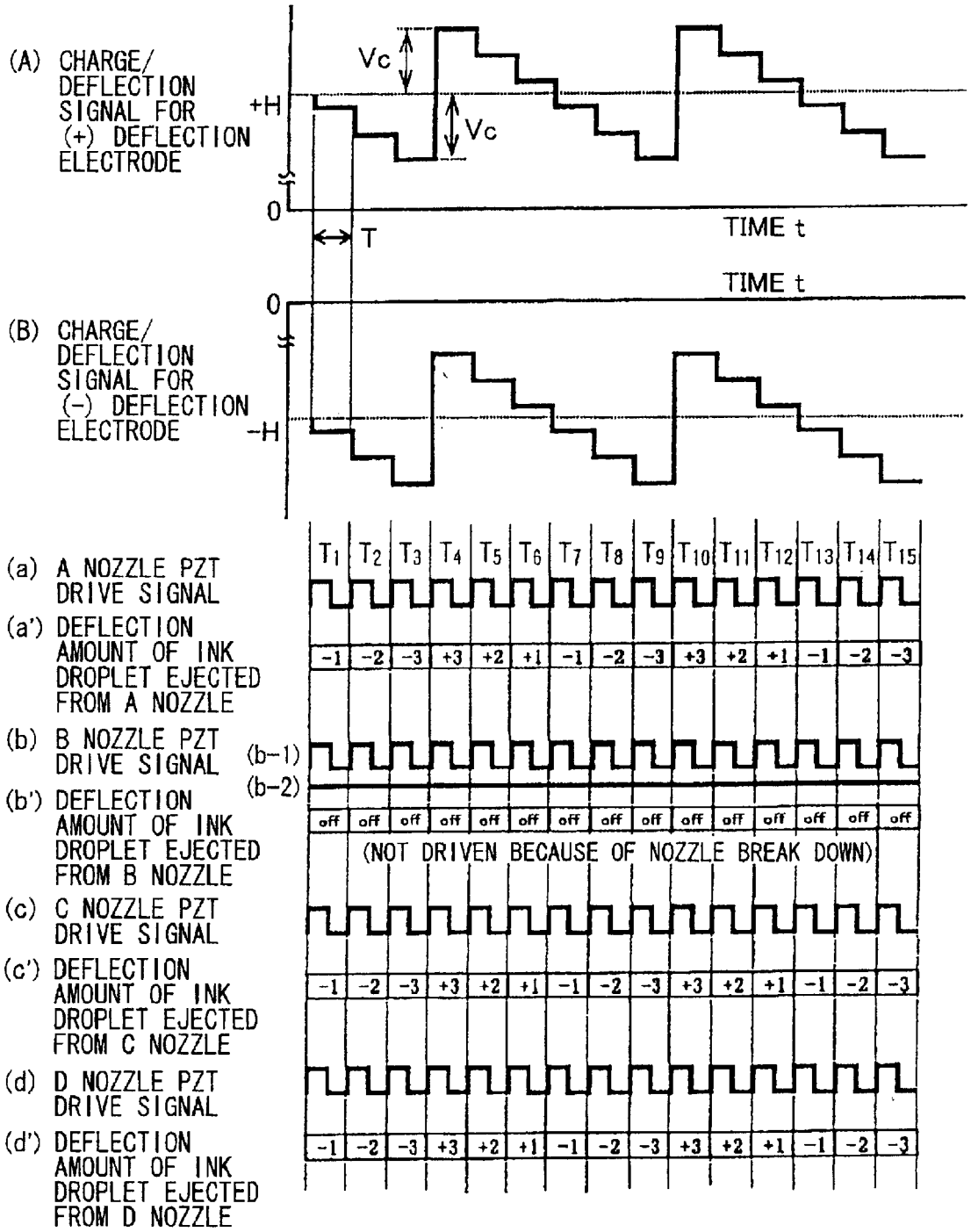
FIG. 17 is a timing chart showing control of the ink jet recording device of FIG. 10.
Figure 18:
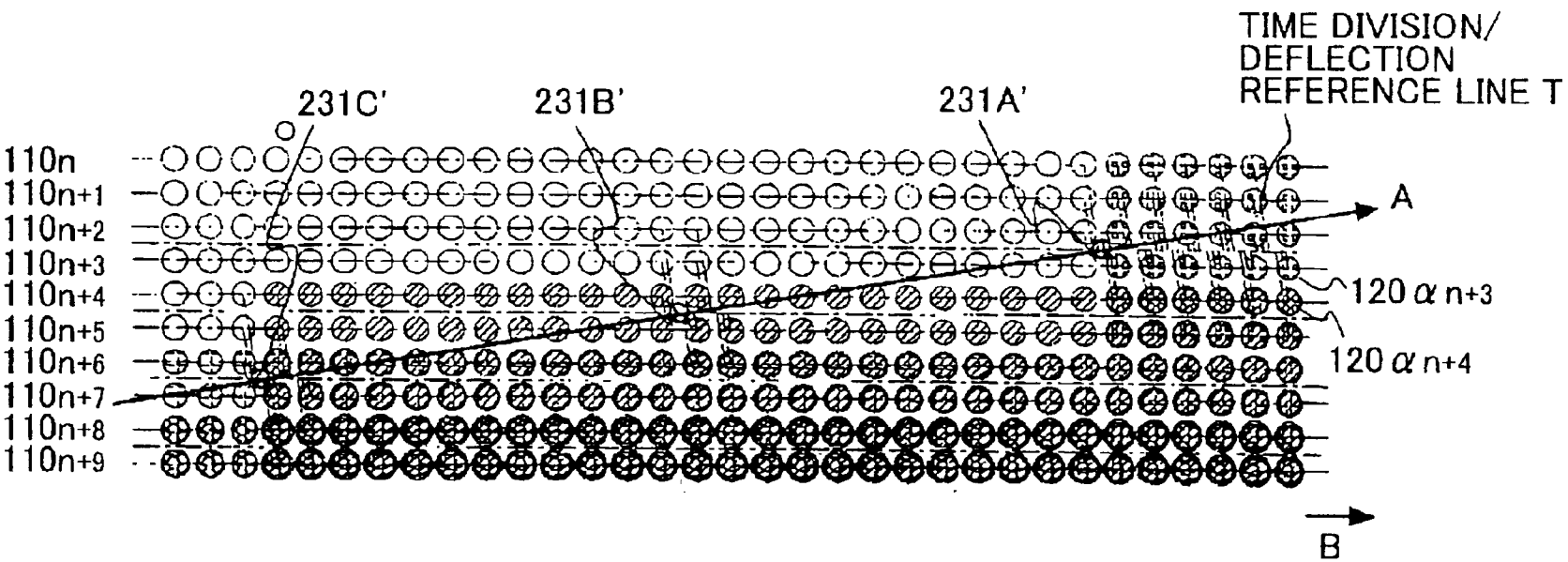
FIG. 18 is a view showing recording dot formation by the recording operation of FIG. 7.

FIGS. 17 and 18 show the condition where the entire recording sheet is printed black when nozzle 231B breaks down and cannot eject ink droplets, and correspond to the drawing showing the condition of normal printing. That is, FIG. 17 is a timing chart showing the charge/deflection signals (A), (B) applied to the charge/deflection electrodes, a PZT drive signal (a) to (d) for each of the nozzles, and a deflection amount (a') to (d') for each of the ink droplets for the case when a recording sheet is printed completely black. FIG. 18 is a drawing showing recording dot formation.

Figure 19:
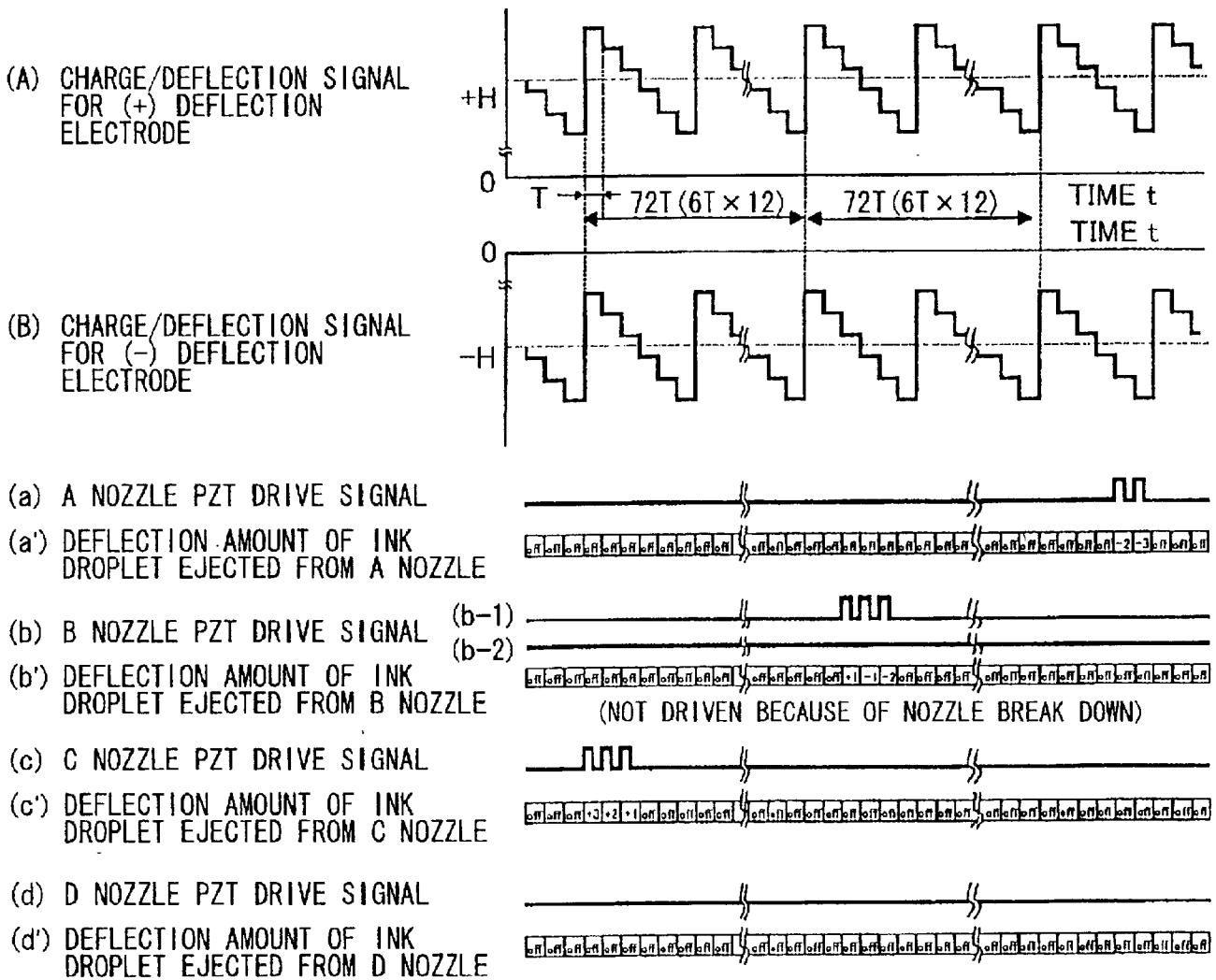
FIG. 19 is a timing chart showing control of the ink jet recording device of FIG. 10.
Figure 20:
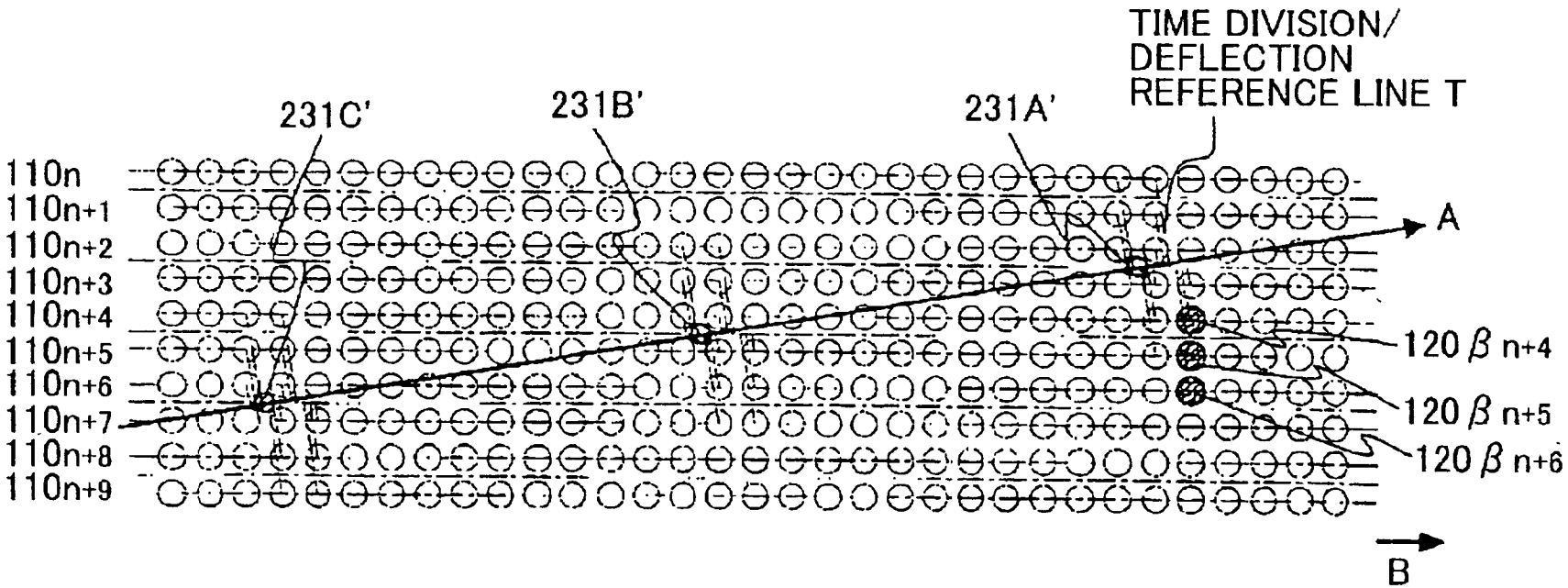
FIG. 20 is a view showing recording dot formation by the recording operation of FIG. 19.

FIGS. 19 and 20 correspond to FIG. 15 showing the normal printing, and show the situation when the nozzle 231B breaks down and can no longer eject ink droplets during printing of short lines made from three pixels. That is, FIG. 19 is a timing chart showing the charge/deflection signals (A), (B), a PZT drive signal (a) to (d) for each of the nozzles, and a deflection amount (a') to (d') for each of the ink droplets for the case when printing the short-line pattern. FIG. 20 shows recording dot formation at that time.

In the conventional recording method where each main scan line is assigned to a corresponding single nozzle, when a nozzle breaks down, a fatal problem arises in that information that should be recorded on a corresponding main scan line is lost. However, according to the present invention, as can be understood from FIGS. 17 and 19, although the nozzle 231B cannot eject ink droplets on assigned pixels on the scan lines 110$_{n+2}$ to 110$_{n+7}$, the adjacent nozzles continue the recording and eject ink droplets to form dots on the pixels. Accordingly, pixels, such as the pixels 120$\beta_{n+4}$, 120$\beta_{n+5}$, and 120$\beta_{n+6}$, can be formed by two recording dots. Although a dot will be less darker than the normal pixels that are recorded by three recording dots, serious problem that information is lost can be avoided, so that recording reliability can be secured.

As described above, according to the present invention, even without detecting defective nozzles, recording can be continued without loss of recording information. Of course, it is possible to detect defective nozzles, stop applying the PZT drive pulse signal to the defective nozzles, and then switch from the signal (B-1) to the signal of (B-2) of FIGS. 17 and 19.

Also, pixels recorded in the present invention all have average size and position because the pixels are configured from recording dots recorded by a plurality of adjacent nozzles. Accordingly, it is possible to reduce recording distortion, such as density distortion and line-like distortions, that is caused by variations in recording dot size due to nozzle characteristics and is a major problem in prior arts, and major problems with conventional line scan ink jet recording devices can be overcome.

In the above example, three recording dots are allotted to a single pixel and a number of nozzles are allotted for each single main scan line. However, this is not a limitation of the present invention, but any desired allotment number can be used by adjusting the means of the invention in accordance with the desired allotment number.

The size of recording dots can be controlled to enhance the recording quality by appropriately setting the size of the pixel and the allotment number of recording dots configuring the pixel. If the recording dots are too large, image resolution is degraded, although the image quality will be less affected by defective nozzles. On the other hand, if the recording dots are too small, then resolution is not degraded, but defective nozzles will greatly affect image quality, and recording density will become insufficient. It is desirable to set the recording dot size taking into consideration these advantages and disadvantages and the application of the printing device.

It should be noted that the diameter of dots recorded on a recording sheet depends on the volume of the ejected ink droplet, on how the ink spreads in the recording sheet, and other factors. Therefore, in cases when the ink and the recording sheet are unchanging, then it is necessary to appropriately set the volume of the ejected ink droplets In order to realize the appropriate volume of ink droplets, the nozzle orifice diameter and the PZT drive pulse waveform of the ink droplet ejection control means are set to appropriate values. That is, the smaller the nozzle orifice diameter, the smaller that the volume of the ink droplet can be made. Also, in general the volume of the ink droplet can be made smaller by narrowing the pulse width or lowering the pulse height of the PZT drive pulse. Further, to make the volume strikingly smaller, it is possible to generate minute droplets in succession by setting the drive pulse waveform so that the meniscus, which is the boundary surface of the ink that develops in nozzle orifices, rapidly retracts into the interior of the nozzle. By using this type of method for adjusting the recording dot diameter, the nozzle and the ink droplet ejection control means of the present invention can eject ink droplets, from a plurality of nozzles, with an optimum volume for forming a single pixel. Also, the impingement position of ink droplets that configure a single pixel need not be the same or nearby positions, but can be intentionally shifted by a suitable amount while maintaining overlap of the recording dots.

As can be understood from FIGS. 13 and 14, ejection of ink droplets and charge/deflection are controlled at an equal time interval T, and the nozzle orifices are arranged so that recording can be performed by allotting ink droplets on pixels arranged at an equidistant interval horizontally and vertically. Because of this, there is no need to require the recording head to have a greater response than necessary. Also, higher-speed recording is possible with nozzles that have the same frequency response. This control is possible because the nozzle orifice arrangement, such as the nozzle pitch and the slant of the nozzle rows with respect to the pixel positions, is appropriately set. However, there is some flexibility in the arrangement of the nozzle orifices and the arrangement of the head when there is leeway in the frequency response of the recording head or when allowed by arranging near pixel positions with an equidistant spacing. Also, when differences appear in the flight speed of ink droplets because of acceleration by the electrostatic field of the charged ink droplets, electrostatic interference between the charged particles, or frequency dependency of the ink droplet ejection characteristic of the nozzles, these can be taken into account by the nozzle orifice arrangement and by controlling ejection timing.

The deflection control means of the present invention uses electrostatic force and includes a charge means and an electric field forming means. The charge means applies a charge to the ink droplets. The electric field forming means is provided on the flight path of the ink droplets for deflecting the charged ink droplets that were charged by the charge means. In the examples shown in FIGS. 3 and 10, these means are easily configured by a pair of electrodes wherein a charge signal voltage superimposed on a deflection voltage is applied between the electrodes and the ink in the nozzles. However, this example is not a limitation of the present invention. The normal electrode configuration that includes a charge electrode and a deflection electrode for generating an electric field separately can be used. In this case the electrodes and the method of applying voltage should be modified.

Also, as described above, according to the present invention, pixels adjacent to each other in the width direction and the main scan direction can be recorded using different nozzles so that recording distortion can be reduced. However, in order to realize this recording distortion reduction function, it is important that the deflection control means controls to enable ink droplets ejected from a plurality of nozzles to impinge onto or nearby the same main scan line for each main scan line in a single main scan movement across the recording medium. Also, the ink droplets ejection control means controls ink droplet ejection timing of ink droplets that are ejected from a plurality of nozzle orifices to be distributed on or near the same main scan line, so that recording dots formed by ink droplets ejected from different nozzle orifices of the plurality of nozzle orifices are aligned alternately in the main scan direction and a direction perpendicular to the main scan direction, or one of these two directions. Further, the nozzle orifices need to be arranged so that recording dots recorded using the deflection control means and the ink droplet ejection control means locate on or nearby pixel positions with predetermined spacing. Accordingly, the embodiment of the present invention is not limited to this example, but can be implemented by changing the allotment number of nozzles per each scan line, the angle of the nozzle rows with respect to the main scan line, the number of deflection levels, the ink ejection control, and the ejection timing control.

Also, in order to provide the back up function described with the above examples, it is important that the deflection control means controls to enable ink droplets ejected from a plurality of nozzles to impinge onto or nearby the same main scan line for each main scan line in a single main scan movement across the recording medium. Also, the ink droplets ejection control means needs to control ejection timing to eject ink droplets from a plurality of nozzles so that ink droplets can impinge on or nearby the same pixel position regardless of which of the plurality of nozzle orifices the ink droplets are ejected from to form a recording dot. Further, the nozzle orifice arrangement means are set so that ink droplets can impinge on or near the same pixel to form a recording dot regardless of which of the plurality of nozzle orifices the ink droplets are ejected from. Accordingly, the embodiment of the present invention is not limited to this example, but can be implemented by changing the allotment number of nozzles per each scan line, the angle of the nozzle rows with respect to the main scan line, the number of deflection levels, the ink ejection control, and the ejection timing control.

Also, as can be understood from FIGS. 7 and 14, the nozzle orifice arrangement means in the above-described example sets the tilt of the nozzle rows with respect to the pixel positions so that ink droplets ejected at an equivalent interval can be distributed to pixels that are arranged at an equidistant spacing. However, there is some flexibility in the nozzle orifice arrangement and the head arrangement when there is leeway in the frequency response of the recording head or when allowed by arranging near pixel positions with equidistant spacing. Also, when differences appear in the flight speed of ink droplets because of acceleration by the electrostatic field of the charged ink droplets, electrostatic interference between the charged particles, or frequency dependency of the ink droplet ejection characteristic of the nozzles, these can be taken into account by the nozzle orifice arrangement and by controlling ejection timing.

The deflection means of the present invention uses electrostatic force and includes a charge means and an electric field forming means. The charge means applies a charge to the ink droplets. The electric field forming means is provided on the flight path of the ink droplets for deflecting the charged ink droplets that were charged by the charge means. In the examples shown in FIGS. 3 and 10, these means are easily configured by a pair of electrodes and by appropriately modifying a charge signal voltage and a deflection voltage applied to the electrodes and the ink in the nozzles. However, this example is not a limitation of the present invention. The following modification is possible.

Figure 21:
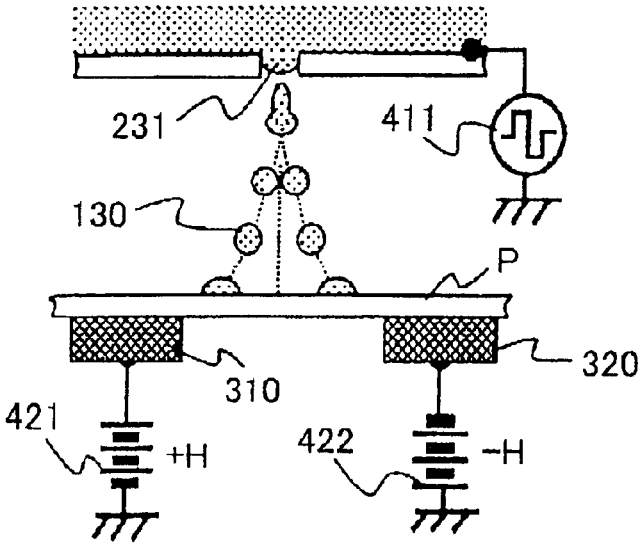
FIG. 21 is a view showing deflection electrode arrangement according to another example of the present invention.

In the electrode arrangement shown in FIG. 21, only a deflection direct current voltage from deflection voltage sources 421, 422 is applied to deflection electrodes 310, 320. A charge control signal from a charge signal source 411 for charging is applied to the ink in the nozzle orifice 231. This configuration requires to electrically insulate the ink from ground, but is advantageous in that the bias circuits 431, 432 are not necessary.

Figure 22:
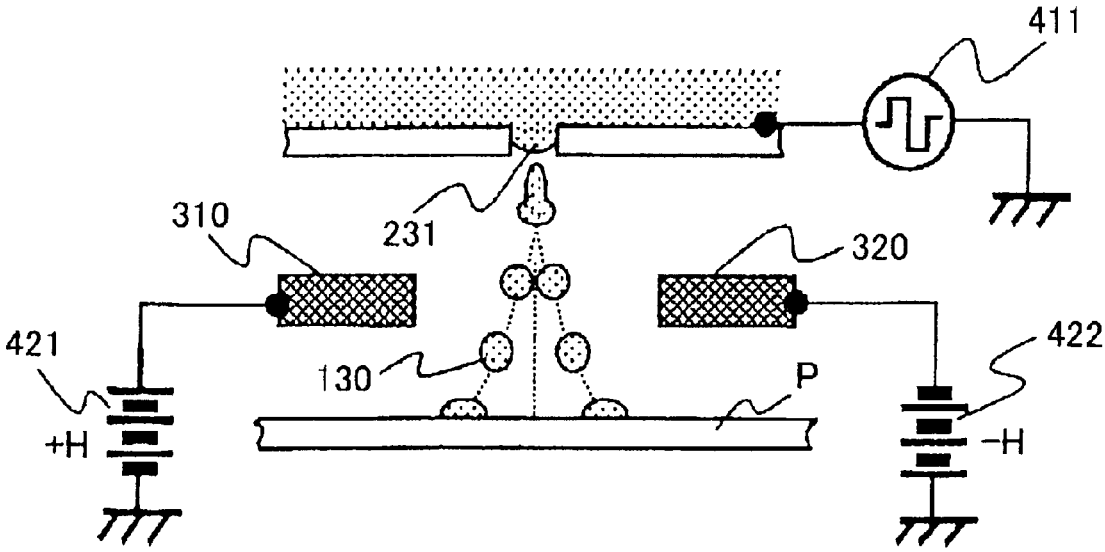
FIG. 22 is a view for explaining a deflection electrode arrangement and its operation according to another example of the present invention.

FIG. 22 shows an example that combines the example of FIG. 21 with the electrode arrangement according to the second modification shown in FIG. 12. That is, the charge/deflection electrodes 310, 320 are arranged above the recording sheet P and a charge signal source 411 is provided. However, the bias circuits 431, 432 are removed from essential configuration.

Figure 23:
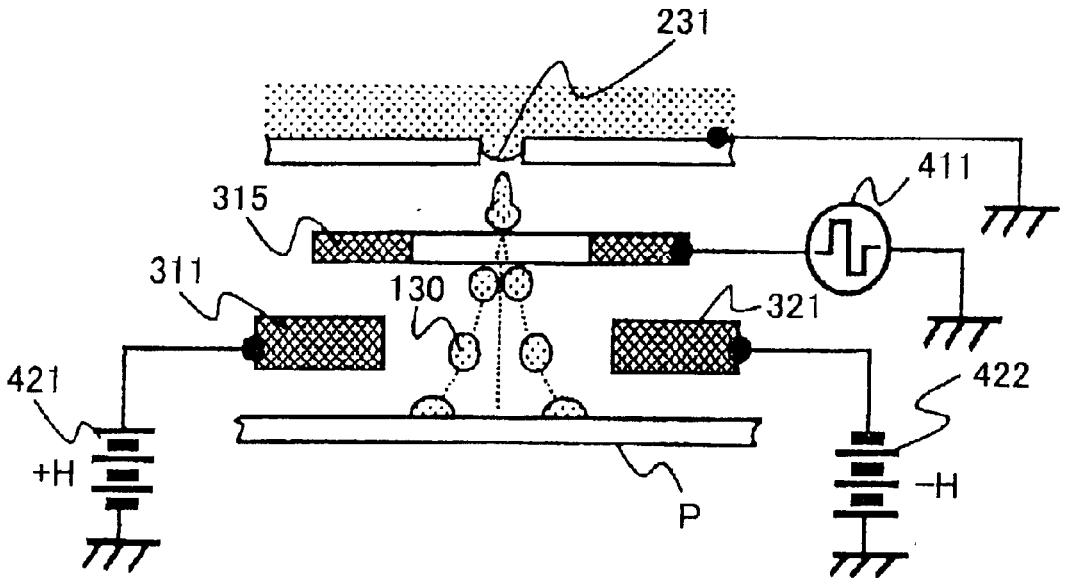
FIG. 23 is a view for explaining a deflection electrode arrangement and its operation according to another example of the present invention.

FIG. 23 shows a configuration wherein the electrodes are divided into electrodes 315 especially for controlling the charge amount of the ink droplets and electrodes 311, 321 especially for forming the deflection electric field. Although the distance that ink droplets must fly increases by the amount that the electrodes increase, the bias circuits are not necessary. Also, there is no need to electrically insulate the ink from ground.

Figure 24:
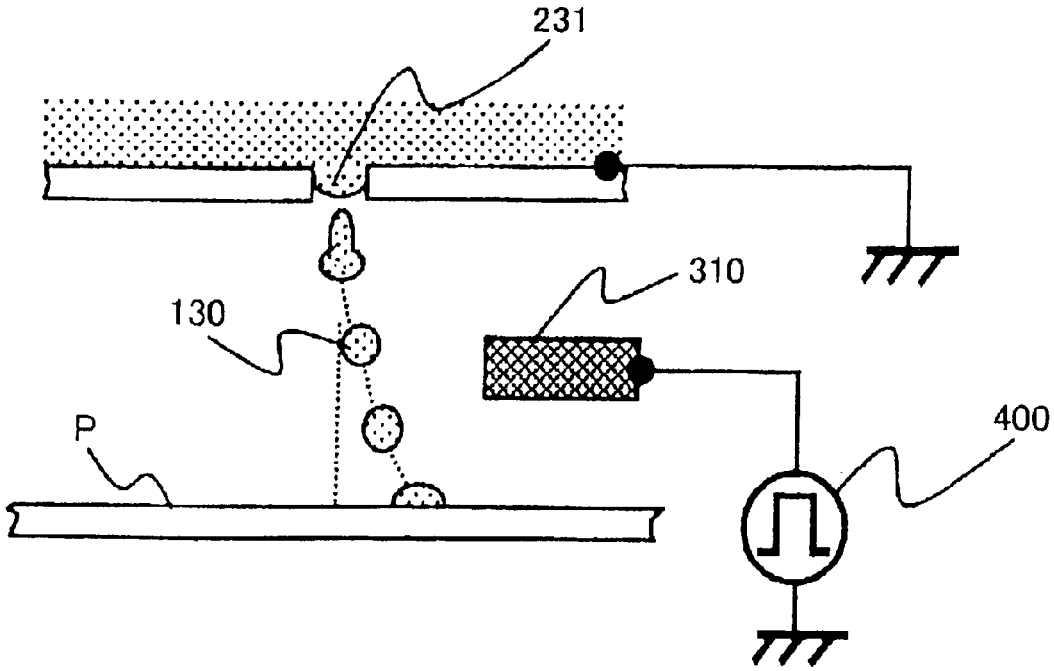
FIG. 24 is a view for explaining a deflection electrode arrangement and its operation according to another example of the present invention.

FIG. 24 shows another example wherein the deflection electrode 310 is disposed on one side of the nozzle row and a high-voltage pulse is applied in, for example, a rectangular waveform from the deflection control signal source 400. Ink droplets 130 are charged by the high-voltage pulse and deflected by the electric field of the same pulse. Although this configuration has a problem of individuality of the deflection control due to narrow flight spacing between ink droplets, it has the advantage that the electrode configuration and the deflection signal control source are simple.

As described above, in order to deflect ink droplets by a predetermined amount, all that needs to be provided according to the present invention is a charge means for applying a charge to the ink droplets and an electrostatic field forming means provided in the flight path of the ink droplets for deflecting the charged ink droplets that were charged by the charge means. Other electrode configurations and voltage applications are possible. For example, the electrodes need not be disposed parallel with the nozzle row, and an electrode could be provided in correspondence with each nozzle.

Although the above example described the present invention applied to a line scan type ink jet recording device, the present invention can be applied to a serial scan type ink jet recording device. That is, the recording head is moved (main scan) in a lateral direction that intersects the continuous direction of the recording sheet while performing the ink droplet ejection deflection control described in the embodiment of the present invention to form a single line's worth of image, then the recording sheet is fed (auxiliary scan) by a predetermined amount in the continuous direction of the recording sheet, and the next line of image is recorded in a main scan. This main scan and auxiliary scan is repeated to record images. Because the recording head is moved in this manner, it is suitable to reduce the number of linear recording head modules that configure the head, to dispose the deflection electrode at the front surface of the recording sheet as shown in FIG. 12, and to move the deflection electrode in association with the recording head. By this, the same effects can be obtained as when the present invention is applied to a line scan type ink jet recording device. Further, because deflection recording enables setting the movement speed of the recording head to a slower speed, non-recording times, such as during acceleration and deceleration of the recording head, can be set shorter than substantial recording times so that higher-speed recording is possible by using the ink droplets ejected from the recording head effectively for recording.

In the above example, electrostatic force was used to deflect the ink droplets. However, if a magnetic ink is used, then magnetic force can be used for the deflection force. Also, the nozzles are not limited to an on-demand ink jet type nozzle that uses piezoelectric elements, such as PZT. On-demand ink jet type nozzles that controls ink ejection based on other principles and configurations can be applied.

According to the present invention, even if several of the nozzles in the ink jet recording head break down, recording can be continued without loss of recording information due to loss of scan lines. The reliability of recording can be strikingly improved. Also, the present invention can realize a high-speed ink jet recording device that can reduce recording distortion caused by poor uniformity between adjacent nozzles of the recording head, that is particularly suitable in an on-demand ink jet type line scan type ink jet recording device, and that is capable of high-quality image recording with high reliability.

According to the present invention, recording can be continued even if several of the nozzles of the ink jet recording head break down, and the number of nozzles mounted on the recording device can be reduced. Therefore, the reliability of recording can be strikingly enhanced. Also, the present invention can provide a high-speed ink jet recording device that can reduce recording distortion caused by poor uniformity between adjacent nozzles of the recording head, that is capable of fine recording, that is particularly suitable in an on-demand ink jet type line scan type ink jet recording device, and that is capable of high-quality image recording with high reliability.

The present invention uses a charge control method, wherein the deflection electric field is normally fixed and deflection amount is controlled by controlling a charge amount of the ink droplets. Accordingly, the charge amount of each ink droplets can be independently and properly controlled. Because deflection is performed by a fixed deflection electric field that does not change with time, independent deflection control of the ink droplets is excellent, and high speed, high quality printing is possible.

What is claimed is:

1. A line scan type ink jet recording device comprising a recording head having plurality of nozzle orifices aligned in a row in a first direction and ink chambers that are opened to the nozzle orifices, the recording head controlling to eject and not eject ink droplets from the nozzle orifices by generating pressure in ink in the ink chambers according to a recording signal, the recording head being disposed so that the nozzle orifices confront a recording medium, and the recording medium being moved relative to the recording head in a second direction to impinge the ink droplets at predetermined pixel positions on a predetermined main scan line for forming a recorded image by recording dots formed on the recording medium by the impinged ink droplets, a deflection means for deflecting ink droplets ejected from the nozzle orifices in a direction that is perpendicular to the main scan line; and an overlap recording control means for controlling ejection timing of and deflecting the ink droplets so that a plurality of ink droplets ejected from a plurality of nozzle orifices impinge in partial overlap on the same pixel position.

2. The line scan type ink jet recording device as claimed in claim 1, wherein the second direction is tilted at a predetermined angle with respect to the first direction.

3. The line scan type ink jet recording device as claimed in claim 1, wherein the overlap recording control means controls volume of each of the plurality of ink droplets ejected from the plurality of nozzle orifices.

4. The line scan type ink jet recording device as claimed in claim 1, wherein the overlap recording control means controls an ink droplet charge means and the ejection timing of the plurality of ink droplets so as to mutually shift the impingement position of the plurality of ink droplets ejected from the plurality of nozzle orifices and consecutively and partially overlap recording dots formed on the recording medium to form a single pixel.

5. The line scan type ink jet recording device as claimed in claim 1, wherein the ejection timing of the plurality of ink droplets controlled by the overlap recording control means is a fixed interval.

6. The line scan type ink jet recording device as claimed in claim 1, wherein the number of the plurality of ink droplets that the overlap recording control means controls is capable of being switched.

7. The line scan type ink jet recording device as claimed in claim 1, wherein the overlap recording control means controls an ink droplet charge means and ejection timing of the plurality of ink droplets so that a nozzle interval in a direction perpendicular to the second direction and an interval of recorded pixels in the direction that is perpendicular to the second direction are different.

8. A line scan type ink jet recording device comprising a recording head having a plurality of nozzle orifices aligned in a row in a first direction and ink chambers that are opened to the nozzle orifices, the recording head controlling to eject and not eject ink droplets from the nozzle orifices by generating pressure in ink in the ink chambers according to a recording signal, the recording head being disposed so that the nozzle orifices confront a recording medium, and the recording medium being moved relative to the recording head in a second direction to impinge the ink droplets at predetermined pixel positions on a predetermined main scan line for forming a recorded image by recording dots formed on the recording medium by the impinged ink droplets, a deflection means for deflecting the ink droplets ejected from the nozzle orifices in a direction that is perpendicular to the main scan line; and an overlap recording control means for controlling ejection timing of and deflecting the ink droplets so that ink droplets ejected from a nozzle orifice that is different from a predetermined nozzle orifice impinges on pixel position on a plurality of main scan lines.

9. The line scan type ink jet recording device as claimed in claim 8, wherein the second direction is tilted at a predetermined angle with respect to the first direction.

10. A line scan type ink jet recording device comprising a recording head having a plurality of nozzle orifices aligned in a row in a first direction and ink chambers that are opened to the nozzle orifices, the recording head controlling to eject and not eject ink droplets from the nozzle orifices by generating pressure in ink in the ink chambers according to a recording signal, the recording head being disposed so that the nozzle orifices confront a recording medium, and the recording medium being moved relative to the recording head in a second direction to impinge the ink droplets at predetermined pixel positions on a predetermined main scan line for forming a recorded image by recording dots formed on the recording medium by the impinged ink droplets, an ink droplet charging means for charging ink droplets ejected from the nozzle orifices to a charge amount that corresponds to a deflection amount of the ink droplets, wherein the ink droplet charging means is the same component as a deflection means for deflecting the charged ink droplets in a direction that is perpendicular to the main scan line.

11. The line scan type ink jet recording device as claimed in claim 10, wherein a charge operation and a deflection operation on the ink droplets is performed simultaneously by applying a charge voltage and a deflection voltage in a superimposed condition to a charge deflection electrode.

12. The line scan type ink jet recording device as claimed in claim 11, wherein the charge deflection electrode is provided on both sides that sandwich the row of nozzle orifices as a common electrode of the single row's worth of nozzle orifices.

13. The line scan type ink jet recording device as claimed in claim 12, wherein the charge deflection electrode is provided between the recording medium and nozzles.

14. The scan type ink jet recording device as claimed in claim 12, wherein the charge deflection electrode is provided at the rear surface of the recording medium.

* * * * *